US007842447B2

(12) United States Patent
Yamazaki et al.

(10) Patent No.: US 7,842,447 B2
(45) Date of Patent: Nov. 30, 2010

(54) TONER

(75) Inventors: Katsuhisa Yamazaki, Numazu (JP); Masami Fujimoto, Shizuoka-ken (JP); Daisuke Yoshiba, Shizuoka-ken (JP)

(73) Assignee: Canon Kabushiki Kaisha (JP)

( * ) Notice: Subject to any disclaimer, the term of this patent is extended or adjusted under 35 U.S.C. 154(b) by 646 days.

(21) Appl. No.: 11/295,230

(22) Filed: Dec. 6, 2005

(65) Prior Publication Data

US 2006/0141380 A1 Jun. 29, 2006

(30) Foreign Application Priority Data

Dec. 6, 2004 (JP) ..... 2004-352911

(51) Int. Cl.
*G03G 9/087* (2006.01)

(52) U.S. Cl. ..... 430/109.4; 430/106.1; 430/109.1; 430/109.2; 430/109.3

(58) Field of Classification Search ..... 430/106.1, 430/109.1, 109.2, 109.4
See application file for complete search history.

(56) References Cited

U.S. PATENT DOCUMENTS 6,881,528 B2 4/2005 Daimon et al.
2002/0098431 A1* 7/2002 Fujikawa et al. ..... 430/106.2
2004/0161688 A1* 8/2004 Itakura et al. ..... 430/108.4
2004/0191656 A1* 9/2004 Ishiyama et al. ..... 430/106.1

FOREIGN PATENT DOCUMENTS

JP 42-23910 B 11/1967
JP 43-24748 B 10/1968

* cited by examiner

*Primary Examiner*—Mark F Huff
*Assistant Examiner*—Peter L Vajda
(74) *Attorney, Agent, or Firm*—Rossi, Kimms & McDowell LLP

(57) ABSTRACT

To provide a toner which allows low temperature fixation irrespective of the configuration of a fuser, which is excellent in offset resistance, and which provides high image quality at high and low humidities in a stable manner without causing any image defect over time. A toner containing: a binder resin and a colorant; in which the toner contains a THF-soluble component to be dissolved in tetrahydrofuran (THF); the binder resin component contained in the THF-soluble component contains: a vinyl resin unit (I) formed by at least a carboxyl group-containing vinyl resin and an epoxy group-containing vinyl resin and having an epoxy value of 0.001 to 1.000 eq/kg and a polyester unit (II) formed by condensation polymerization of monomers each containing fatty acid having 4 to 12 carbon atoms, aromatic tricarboxylic acid, and ethylene glycol; and the toner has a main peak present in a molecular weight region ranging from 3,000 to 30,000 on the measurement of a molecular weight distribution of the THF-soluble component by gel permeation chromatography (GPC).

13 Claims, No Drawings

TONER

BACKGROUND OF THE INVENTION

Field of the Invention

The present invention relates to an image forming method for visualizing electrophotography and electrostatic charge images, and to a toner for use in a toner jet.

Conventionally, various methods including an electrophotographic method, a magnetic recording method, and a toner jet method have been known as image forming methods. In particular, various methods described in publications such as U.S. Pat. No. 2,297,691, JP 42-23910 B, and JP 43-24748 B have been proposed as electrophotographic methods. In such image forming methods, generally, a photoconductive substance is used and an electric latent image is formed on a photosensitive member by any of various means. Then, the latent image may be developed with a toner and converted into a visible image. Further, in the image forming method, if required, the toner is transferred to a transfer material such as paper and the toner image is then fixed on the transfer material under heat, pressure, or the like, to thereby obtain a copy. In the image forming method, the residual toner on the photosensitive member, which failed to be transferred, is removed by any of various methods.

For the above process, in recent years, smaller and lighter copying machines used with such image forming methods with higher process speed and reliability have been severely demanded. For instance, such a copying machine is provided not only just as one for paperwork, which is commonly used for copying an original, but also as a digital printer used as an output of a computer or as one for copying an image in a high resolution such as graphic design. Further, such a copying machine has also come into use for near-print (print-on-demand application that allows a wide variety of print products in small quantities in editing, printing, and bookbinding works with personal computers) that requires more reliability. Therefore, an image with higher definition and higher image quality has been demanded, and hence higher performance has been also demanded for a toner.

Conventionally, for toner resins, vinyl copolymers such as polyester units and styrene resins have been dominantly used. The polyester unit intrinsically has a superior fixing ability at low temperatures, but also has a disadvantage in that an offset phenomenon tends to be caused at high temperatures. For covering such a disadvantage, the viscosity of the polyester unit may be increased by producing an increase in molecular weight thereof. In this case, however, the polyester unit will lose its fixing ability at low temperatures and lower its grindability in the production of toner, which may sometimes result in unsuitable powdering of toner.

On the other hand, any of vinyl copolymer such as a styrene resin has excellent grindability in the production of toner and can be easily produced in high molecular weight, so that it will exert an excellent offset resistance at high temperatures. For improving its fixing ability at low temperatures, the molecular weight of the vinyl copolymer may be decreased. However, the decrease in the molecular weight of the vinyl copolymer may cause a decrease in blocking resistance or developing ability.

Until now, considerations have been made on several methods in which those two different resins are mixed to utilize the advantages of those resins while covering the disadvantages thereof. For instance, JP 54-114245 A discloses a toner containing a resin prepared by mixing a polyester resin and vinyl copolymer. However, there is intrinsically poor compatibility between the polyester resin and the vinyl copolymer, so that all of fixing ability at low temperatures, offset resistance at high temperatures, and blocking resistance are hardly satisfied at the same time unless those resins are compounded at appropriate ratios.

Moreover, the toner tends to cause a disadvantage in its developing ability because of insufficient dispersion of a colorant, wax, or the like added in the time of production of toner. In recent years, such a disadvantage becomes apparent in finely pulverized toners.

For instance, JP 5-88403 A discloses a method of improving the dispersibility of any of raw materials in a toner by improving the compatibility between a vinyl resin and a polyester resin by determining the molecular weight of the vinyl resin and the mixing ratio thereof with the polyester resin. In addition, JP 2002-229263 A discloses a method of improving the dispersibility of a raw material in toner by ingeniously designing a manufacturing method (kneading method) of a toner using a mixture of resins.

Those methods will allow toners to be improved in their dispersibilities of colorants, wax, and the like to be added therein and developing abilities. In contrast, the conventional methods still retain their disadvantages to be solved in consideration of the use of toner in applications that demand higher reliabilities and stabilities, such as in copy process of high fine images for graphic designs or the like, or further in near-print process (print-on-demand application that allows a wide variety of print products in small quantities in editing, printing, and bookbinding works with personal computers).

Furthermore, for instance, in each of JP 56-116043 A and JP 58-159546 A, there is disclosed a toner characterized by containing a polymer obtained by polymerizing monomers in the presence of a polyester resin. In addition, for example, each of JP 58-102246A and JP 01-156759A discloses a toner characterized by containing a polymer obtained by polymerizing a vinyl copolymer in the presence of unsaturated polyester. Furthermore, for example, JP 02-00881 A discloses a toner characterized by containing a polymer obtained by esterification of a styrene resin and a polyester resin each having a predetermined acid value.

Furthermore, for example, in each of JP 11-194536 A and JP 2000-56511 A, there is disclosed a toner using at least two resins selected from a polyester resin, a styrene resin, and a resin obtained by a partial reaction between the polyester resin and the styrene resin.

These toners attain an improvement in compatibility between a polyester resin and a vinyl copolymer but still retain their disadvantages in terms of providing those having wide range of temperatures for fixing thereof and excellent offset resistances.

Furthermore, JP 64-35454A and JP 11-249339A disclose toners characterized in that crystalline polymers and noncrystalline polymers with predetermined melting points and so on are used as binder resin. Those toners attain an improvement in fixing ability but are insufficient in dispersibility of a colorant, wax, or the like to be added therein. Considering the use in application that requires higher reliability and stability, they still have disadvantages to be solved.

Furthermore, for example, in JP 2002-221813 A, there is disclosed a toner characterized by containing a vinyl resin having an epoxy group and a vinyl resin having a carboxyl group. The toner exerts some effects in a certain fixing system but still has disadvantages to be solved in terms of securing a wide range of temperatures for fixing thereof without depending on the configuration of a fixing apparatus.

Furthermore, JP2004-233983A discloses that the epoxy group of a vinyl resin having such an epoxy group is reacted with the carboxyl group of a resin having a polyester unit and such a carboxyl group to obtain toner having an excellent offset resistance as well as improved transparency of an OHP sheet. In this case, however, the toner still has disadvantages to be solved for a further improvement in fixing ability.

SUMMARY OF THE INVENTION

Therefore, an object of the present invention is to provide a toner in which the above disadvantages have been solved.

Concretely, an object of the present invention is to provide a toner capable of being fixed at low temperatures without depending on the configuration of a fixing apparatus and having an excellent offset resistance as well as stability in high image quality even after the use at high and low humidities, while hardly causing any defect in an image with time.

A further object of the present invention is to provide a toner having excellent productivity.

The present invention is characterized by a toner containing a binder resin and a colorant; in which the toner contains a THF-soluble component to be dissolved in tetrahydrofuran (THF) a binder resin component in the THF-soluble component contains: a vinyl resin unit (I) formed by at least a carboxyl group-containing vinyl resin and an epoxy group-containing vinyl resin and having an epoxy value of 0.001 to 1.000 eq/kg and a polyester unit (II) formed by condensation polymerization of monomers each containing fatty acid having 4 to 12 carbon atoms, aromatic tricarboxylic acid, and ethylene glycol; and the toner has a main peak in a molecular weight region ranging from 3,000 to 30,000 on measurement of a molecular weight distribution of the THF-soluble component by gel permeation chromatography (GPC).

Also, it is preferable that an area of a molecular weight of 100,000 or less in a chromatogram for the molecular weight distribution accounts for 70 to 100% of the whole area.

In addition, the toner of the present invention preferably contains 10 to 50% by mass of a THF-insoluble component at a 16-hour extraction with THF with respect to the total amount of a resin component in the toner.

Preferably, in the toner of the present invention, the carboxyl group-containing vinyl resin has at least one peak in a molecular weight region ranging from 4,000 to 30,000 and at least one peak in a molecular weight region ranging from 100,000 to 400,000 on measurement of the molecular weight distribution by gel permeation chromatography (GPC).

Preferably, in the toner of the present invention, the epoxy group-containing vinyl resin has a weight average molecular weight of 3,000 to 40,000 on measurement of the molecular weight distribution by gel permeation chromatography (GPC) and the epoxy group-containing vinyl resin has an epoxy value of 0.01 to 5.00 eq/kg.

Preferably, in the toner of the present invention, the vinyl resin unit (I) is formed by a carboxyl group-containing vinyl resin and an epoxy group-containing vinyl resin having 0.05 to 5.00 moles of an epoxy group per mole of a carboxyl group in the carboxyl group-containing vinyl resin.

Preferably, in the toner of the present invention, the polyester unit (II) has at least one peak in a molecular weight region ranging from 3,000 to 10,000 on measurement of the molecular weight distribution by gel permeation chromatography (GPC) and has a weight average molecular weight (Mw) of 3,000 to 15,000.

Preferably, in the toner of the present invention, the polyester unit (II) has a maximum endothermic peak in a DSC (differential scanning calorimeter) curve in a region ranging from the temperature of 50 to 100° C. when the thermal properties thereof are determined by means of a differential scanning calorimeter.

Preferably, in the toner of the present invention, the binder resin contains the carboxyl group-containing vinyl resin and the polyester unit (II) so that 0.01 to 10.00 moles of the carboxyl group in the polyester unit (II) is contained with respect to 1.00 mole of the carboxyl group in the vinyl resin unit (I).

Furthermore, in the present invention, it is preferable that the colorant is magnetic iron oxide.

Furthermore, in the present invention, it is preferable that the magnetic iron oxide contains magnetic iron oxide particles each having an octahedron form and/or magnetic iron oxide particles each having a multinuclear form.

Furthermore, in the present invention, the content of the magnetic iron oxide is preferably 20 to 200 parts by mass with respect to 100 parts by mass of the binder resin.

DETAILED DESCRIPTION OF THE INVENTION

The inventors of the present invention have proceeded the investigation on the constituent materials used in toner. The inventors of the present invention found that a toner having both high fixing ability and high developing ability can be obtained by preparing the toner in such a manner that a binder resin component in a THF-soluble component in the toner contains a vinyl resin unit (I) formed by at least a carboxyl group-containing vinyl resin and an epoxy group-containing vinyl resin with a specific epoxy value and a polyester unit (II) formed by specific monomers, while the molecular distribution of the THF-soluble component in the toner is adjusted to a predetermined range.

The toner of the present invention contains at least a binder resin and a colorant. The toner of the present invention contains a THF-soluble component which is soluble in THF and the binder resin contains a binder resin component in the THF-soluble component. The binder resin component contains a vinyl resin unit (I) and a polyester unit (II). The vinyl resin unit (I) is one formed by a carboxyl group-containing vinyl resin and an epoxy group-containing vinyl resin and has an epoxy value of 0.001 to 1.000 eq/kg. The polyester unit (II) is one prepared by a condensation polymerization of monomers each containing at least fatty acid having 4 to 12 carbon atoms, aromatic tricarboxylic acid, and ethylene glycol.

According to the investigation conducted by the inventors of the present invention, it is found that using the vinyl resin unit (I) and the polyester unit (II) appropriately branched by aromatic tricarboxylic acid as binder resins of the toner allows an improvement in compatibility of two different binder resins by virtue of the interaction between the epoxy group and the aromatic tricarboxylic acid. As a result, it becomes possible to obtain a uniformly charged toner having excellent performance stability as well as excellent dispersibility of raw materials including a magnetic body and a colorant such as a pigment or a dye in toner particles, while these raw materials can be prevented from falling out of the toner particles. Furthermore, it is found that the uniform charge of the toner can lower the consumption of toner per sheet of printed paper.

In the case where the vinyl resin unit (I) has an epoxy value of less than 0.001 eq/kg, the interaction between the vinyl resin unit (I) and the polyester unit (II) formed by the monomers hardly occurs and the compatibility between the vinyl resin unit and the polyester unit may deteriorate and it may result in deterioration of dispersibility of raw materials in toner particles. As a result, the toner can be charged broadly and a problem, such as a decrease in image concentration or progression of fogging in continual use, may be caused. Furthermore, the amount of toner consumed per sheet of printing paper may be increased.

Furthermore, if the vinyl resin unit (I) has an epoxy value of more than 1.000 eq/kg, the epoxy group of the vinyl resin unit and the carboxyl group of the polyester unit can be interacted too strongly and the resins may tend to be completely compatibilized with each other. In this case, the developing and fixing abilities of each of the vinyl resin and the polyester unit, which are their advantageous features, cannot be exploited sufficiently. As a result, a decrease in image density in continual use, deterioration of fixing ability, and a decrease in offset resistance at high temperatures may occur.

Furthermore, when the vinyl resin unit (I) has an epoxy value of more than 1.000 eq/kg, the vinyl resin unit (I) and the polyester unit (II) can be mixed with other raw materials while both resin being highly compatibilized with each other in the production of toner, causing difficulty in attaining their contents enough to contribute to the dispersibilities of the other raw materials. Consequently, the dispersibilities of the other raw materials in toner particles may be deteriorated. Besides, as the vinyl resin unit and the polyester unit become highly compatibilized with each other, the glass transition temperature of the toner may decrease, thereby making the storage stability of the toner worse.

The epoxy value of the vinyl resin unit (I) can be adjusted, for example, by adjusting the blending amount of the epoxy group-containing resin in the toner. In addition, the binder resin component in the toner particles can be determined by a THF-dissolution test or any other analytical procedures including infrared emission spectroscopy and mass spectrometry.

The polyester unit (II) used in the present invention may be a polyester unit prepared by a condensation polymerization of monomers each containing aliphatic dicarboxylic acid having 4 to 12 carbon atoms, aromatic tricarboxylic acid, or ethylene glycol. For effectively exerting the compatibility with the vinyl resin unit, three different predetermined monomers will be required as essential components. When the polyester unit prepared using monomers including at least one different from the above three monomers is employed, the compatibility between the vinyl resin unit and the polyester unit may deteriorate and then the dispersibilities of the raw materials in toner particles may deteriorate. As a result, the toner can be charged broadly and a problem, such as a decrease in image density or progression of fogging in continual use, may be caused. Furthermore, the amount of toner consumed per sheet of printing paper may be increased.

Using a flexible polyester unit being appropriately branched with aromatic tricarboxylic acid instead of an aliphatic polyester unit prepared only from aliphatic dicarboxylic acid having 4 to 12 carbon atoms and ethylene glycol can effectively satisfy the fixing ability at low temperatures and the offset resistance at high temperatures.

Furthermore, the toner of the present invention is characterized in that the toner has a main peak in a molecular weight region of 3,000 to 30,000 in the molecular weight distribution of the THF-soluble component in toner particles measured by gel permeation chromatography (GPC).

As the toner has a main peak in the molecular weight region of 3,000 to 30,000 in the GPC analysis, the toner is allowed to attain good fixing ability at low temperatures and good blocking resistance. Besides, retaining such a molecular distribution allows to apply appropriate shearing force at the kneading step in the production of toner, thereby causing a synergic effect, a compatibilizing effect, of using both the vinyl resin unit (I) and the polyester unit (II) concomitantly with each other. As a result, the dispersibility of a colorant, a releasing agent, or the like, which can be used as a raw material of the toner, can be improved additionally. Thus, the toner will have improved developing ability in enduring use.

Furthermore, the improved dispersibility of a colorant, a releasing agent, or the like, which can be used as a raw material of the toner, makes the charging properties of the toner uniform, leading to an improvement in image quality such as dot reproducibility. Furthermore, the uniform charging can lower the consumption of toner per sheet of printed paper.

If the main peak measured by the GPC falls out of the range described above, the dispersibility of any raw material in toner particles may deteriorate and also the blocking resistance may deteriorate when the main peak is placed at a molecular weight of less than 3,000. As a result, the toner will be charged broadly, causing troubles such as a decrease in image density and heavy fogging in continual use. Besides, the quality of an image such as dot reproducibility may deteriorate. Furthermore, the consumption of toner per sheet of printed paper may be increased. Furthermore, if the main peak determined by the GPC is placed at a molecular weight of more than 30,000, the toner is hardly provided with sufficient fixing ability.

Furthermore, it is preferable that the peak area corresponding to molecular weights of 100,000 and below in a chromatogram from the GPC analysis is 70 to 100% with respect to the whole peak area. If the peak area corresponding to molecular weights of 100,000 and below is less than 70%, the toner may not attain its fixing ability sufficiently.

The position and area of the peak can be adjusted, for example, by considering the molecular weight or mixing ratio of the vinyl resin unit or the polyester unit, the use of a cross-linking agent in the production of toner, and the mixing conditions in the production of toner.

As described above, the dispersibilities of raw materials in toner can be well controlled by adding the vinyl resin unit (I) having a specific epoxy value, which is formed by the carboxyl group-containing vinyl resin and the epoxy group-containing vinyl resin, and the polyester unit (II) formed by specific monomers to the binder resin component included in the THF-soluble component in toner particles and then controlling the molecular weight distribution of the THF-soluble component in the toner. As a result, the toner having both the fixing ability and the developing ability well compatible with each other can be obtained.

Furthermore, the amount of a THF-insoluble component obtained by subjecting the toner of the present invention to extraction with THF for 16 hours is preferably 10 to 50% by mass, more preferably 20 to 50% by mass with respect to the whole amount of resin components in the toner.

The THF insoluble component is a component effective to allow the toner to exert its good releasing ability from a heating member such as a fixing roller. Thus, when the toner is employed in a high-speed machine, there is a lowering effect on the offset of toner to a heating member such as a fixing roller. If the content of the THF-insoluble component is less than 10% by mass, the above effect can be hardly exerted. If it exceeds 50% by mass, on the other hand, the fixing ability of the toner may deteriorate and the dispersibilities of raw materials in toner particles may also deteriorate. Thus, the toner tends to have uneven distribution of charges.

The content of the THF-insoluble component can be adjusted, for example, by considering the molecular weight or mixing ratio of the vinyl resin unit (I) or the polyester unit (II), the use of a cross-linking agent in the production of toner, the mixing conditions in the production of toner, or the use of an additional resin having a high molecular weight other than the vinyl resin unit (I) and the polyester unit (II) as a binder resin.

The carboxyl group-containing vinyl resin is preferably formed by a low-molecular weight resin component and a high-molecular weight resin component. The main-peak in molecular weight (MpL) of the low-molecular weight resin component is preferably in the range of 4,000 to 30,000 in terms of attaining good fixing ability and blocking resistance. The main-peak in molecular weight (MpH) of the high-molecular weight resin component is preferably in the range of 100,000 to 400,000 in terms of attaining good offset property and durability.

Furthermore, using the carboxyl group-containing vinyl resin having such a molecular distribution, it becomes possible to attain a further improvement in dispersibility of a colorant, a mold-releasing agent, or the like used as a raw material in the toner by a synergic effect with a compatibilizing effect due to concomitant use of the vinyl resin unit (I) and the polyester unit (II), resulting in an additional improvement in developing ability in continual use.

The main-peak in molecular weight of each resin component can be adjusted, for example, by considering the degree of polymerization of the resin components, by cross-linking of the resin components, or by subjecting to a thermal or mechanical process.

Furthermore, the acid value of the carboxyl group-containing vinyl resin is preferably 0.5 to 50.0 mg KOH/g, more preferably 1.0 to 30.0 mg KOH/g. If the acid value is less than 0.5 mg KOH/g, tangled components are hardly generated because the number of moieties of carboxyl and epoxy groups, which participate in a cross-linking reaction, decreases. If the acid value exceeds 50.0 mg KOH/g, the negative charging property of the binder resin in toner particles becomes stronger when the toner of the present invention is one having a positive charging property. As a result, a decrease in image density and an increase in fogging tend to occur.

Furthermore, it is preferable to design the high-molecular weight resin component to have a higher acid value and to design the low-molecular weight resin component to have a lower acid value. Specifically, the high-molecular weight resin component has an acid value of preferably 10.0 to 60.0 mg KOH/g, more preferably 10.0 to 30.0 mg KOH/g, and the low-molecular weight resin component has an acid value of preferably 5.0 mg KOH/g or less. Such definitions of the resin components are provided for attaining an improvement in offset resistance without affecting the fixing ability at low temperatures by selectively reacting the carboxyl group-containing vinyl resins, particularly the high-molecular weight resin component thereof, with the epoxy group-containing vinyl resin.

The acid value of the carboxyl group-containing vinyl resin or each of the resin components can be adjusted, for example, by considering the types of monomers which constitute them and the amounts thereof to be used.

The glass transition temperature (Tg) of the carboxyl group-containing vinyl resin is preferably 40 to 70° C. If Tg is lower than 40° C., the blocking resistance of the toner may deteriorate. If Tg exceeds 70° C., the fixing ability of the toner may deteriorate. The Tg of each of the resin components or the carboxyl group-containing vinyl resin may be adjusted depending on, for example, the type or amount of the monomer constituting them.

Further, to obtain the carboxyl group-containing vinyl resins (a high-molecular weight resin component and a low-molecular weight resin component), vinyl monomers each having a carboxyl group as follows can be used. Examples of the monomers each having a carboxyl group include: maleic acid, citraconic acid, dimethyl maleate, itaconic acid, alkenylsuccinic acid, and anhydrides thereof; unsaturated dibasic acids such as fumaric acid, metaconic acid, and dimethyl fumarate, and anhydrides thereof; monoesters of the above-mentioned unsaturated dibasic acids; α,β-unsaturated acids such as acrylic acid, methacrylic acid, crotonic acid, and cinnamic acid, and anhydrides thereof; anhydrides of the above-mentioned α,β-unsaturated acids with lower aliphatic acids; and alkenylmalonic acid, alkenylglutaric acid, and alkenyladipic acid, and anhydrides thereof and monoesters thereof.

Among them, each of maleic acid, a maleic acid half ester, and maleic anhydride is particularly preferably used as a vinyl monomer to obtain carboxyl group-containing vinyl resins used in the present invention.

Further, a comonomer that polymerizes with a vinyl monomer having a carboxyl group includes as below. At least one of the vinyl monomers including: styrene and styrene derivatives such as styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylene unsaturated monoolefins such as ethylene, propylene, butylene, and isobutylene; unsaturated polyenes such as butadiene; vinyl halides such as vinyl chloride, vinylidene chloride, vinyl bromide, and vinyl fluoride; vinyl esters such as vinyl acetate, vinyl propionate, and vinyl benzoate; α-methyl aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; acrylate or methacrylate derivatives such as acrylonitrile, methacrylonitrile, and acrylamide; and the above-mentioned α,β-unsaturated acid esters and dibasic diesters, may be used.

Among them, monomers are preferably combined to provide either of a styrene-acrylic copolymer or a styrene-methacrylic copolymer.

The styrene-acrylic copolymer or the styrene-methacrylic copolymer is preferable because the vinyl resin unit (I) can be formed by making an interaction of the carboxyl groups existing in some places on the polymer chain of the styrene copolymer with the epoxy group of the epoxy group-containing vinyl resin and by efficiently entangling each other.

In addition to the above monomer, if required, resins may be cross-linked with a cross-linking monomer (cross-linking agent) shown below. A monomer having two or more polymerizable double bonds is mainly used as the cross-linking monomer.

Examples of such cross-linking monomers include: aromatic divinyl compounds such as divinylbenzene and divinylnaphthalene; diacrylate compounds bonded together with alkyl chains such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and those obtained by changing the "acrylate" of the above-mentioned compounds to "methacrylate"; diacrylate compounds bonded together with alkyl chains each containing an ether bond such as diethylene glycol diacrylate, triethylene glycol diacrylate, tetraethylene glycol diacrylate, polyethylene glycol #400 diacrylate, polyethylene glycol #600 diacrylate, and dipropylene glycol diacrylate, and those obtained by changing the "acrylate" of the above-mentioned compounds to "methacrylate"; diacrylate compounds bonded together with chains each containing an aromatic group and an ether bond such as polyoxyethylene (2)-2,2-bis(4-hydroxyphenyl)propane diacrylate and polyoxyethylene(4)-2,2-bis (4-hydroxyphenyl)propane diacrylate, and those obtained by changing the "acrylate" of the above-mentioned compounds to "methacrylate"; and polyester-type diacrylate compounds.

Examples of the polyfunctional cross-linking monomer include: pentaerythritol triacrylate, trimethylolethane triacrylate, trimethylolpropane triacrylate, tetramethylolmethane tetraacrylate, and oligoester acrylate, and those obtained by changing the "acrylate" of the above-mentioned compounds to "methacrylate"; and triallyl cyanurate and triallyl trimellitate.

Each of these cross-linking agents is preferably used in an amount of about 0.01 to 5.00 parts by mass (more preferably about 0.03 to 3.00 parts by mass) with respect to 100 parts by mass of a vinyl monomer component.

For producing each of the carboxyl group-containing vinyl resin and the epoxy group-containing vinyl resin used in the present invention, selection of kinds of polymerization initiator, solvent and reaction conditions is critical elements to obtain the various resins mentioned above. Examples of available polymerization initiators include: organic peroxides such as benzoyl peroxide, 1,1-di(t-butylperoxy)-3,3,5-trimethylcyclohexane, n-butyl-4,4-di(t-butylperoxy)valerate, dicumyl peroxide, α, α'-bis(t-butylperoxydiisopropyl) benzene, t-butyl peroxycumene, and di-t-butyl peroxide; and azo and diazo compounds such as azobisisobutyronitrile and diazoaminoazobenzene.

A method of synthesizing a low-molecular-weight resin component of a carboxyl group-containing vinyl resin in accordance with the present invention may be any of the methods well known in the art. A bulk polymerization method is able to provide a low-molecular-weight resin component by carrying out polymerization at high temperatures and facilitating a velocity of chain termination. In this case, however, there is a problem in that the reaction is hardly controlled. In contrast, a solution polymerization method is preferable to obtain a low-molecular-weight resin component because a low-molecular-weight resin component can be obtained under mild conditions using the difference of velocity of radical chain transfer with a solvent or adjusting the amount of a polymerization initiator or reaction temperature during polymerization.

The solvents used in the solution polymerization include xylene, toluene, cumene, cellosolve acetate, isopropyl alcohol, and benzene. When a styrene monomer is used, the solvent is preferably xylene, toluene, or cumene. The solvent may be suitably selected depending on the type of monomer to be polymerized.

During polymerization, although a reaction temperature varies depending on a solvent used, a polymerization initiator, and a monomer polymerized, it is preferable to carry out the reaction at 70 to 23° C. in general. In the solution polymerization, it is preferable to carry out reaction with 30 to 400 parts by mass of a monomer with respect to 100 parts by mass of the solvent. Furthermore, after completion of the polymerization, the polymer may also be preferably added with one or more of other polymers in the solution.

Examples of a method of synthesizing a high-molecular weight resin component of a carboxyl group-containing vinyl resin include a bulk polymerization method, a solution polymerization method, an emulsification polymerization method, and a suspension polymerization method. The emulsification polymerization method involves: dispersing a monomer substantially insoluble in water as fine particles in an aqueous phase with an emulsifier; and then carrying out polymerization using a water-soluble polymerization initiator. In this method, it is easy to adjust the degree of a reaction heat and a velocity of chain termination is small because a phase for polymerization (an oily phase constructed of the polymer and monomer) is separated from an aqueous phase. In this case, as a result, the polymerization velocity is higher than usual and thus the resin having a higher polymerization degree is obtained.

Furthermore, the emulsification polymerization method is advantageous for the production of the binder resin for a toner. Because the polymerization process is relatively simple, and a polymerized product is a fine particle, hence a mixture of an additive such as a colorant or a charge control agent and the polymerized product is easily prepared in the production of the toner.

It is noted that a polymer is apt to be impure because of the added emulsifier and any suitable procedure such as a salting out process may be required for collecting the polymer. For avoiding such inconvenience, a suspension polymerization method is preferably used.

However, the most desirable method as a method of synthesizing a high-molecular weight resin component in the carboxyl group-containing vinyl resin used in the present invention is a solution polymerization method. This is because the solution polymerization method can be carried out under mild conditions, carboxyl groups required for cross-linking can be introduced into the high-molecular weight component, while the distance between cross-linking points is controlled.

Besides, the high-molecular weight resin component formed by the solution polymerization method represents good compatibility at the time of mixing with the low-molecular-weight resin component. Consequently, the method provides a further improvement in developing ability of the toner and thus the solution polymerization method is preferable.

Further, the epoxy group-containing vinyl resin may be formed by polymerization of a monomer including an epoxy group-containing monomer. The epoxy group-containing monomer is a compound containing vinyl and epoxy groups such as an ester consisting of a glycidyl alcohol and an unsaturated carboxylic acid, an unsaturated glycidyl ether, or the like. Specific examples thereof include glycidyl acrylate, glycidyl methacrylate, β-methylglycidyl acrylate, β-methylglycidyl methacrylate, acrylglycidyl ether, and allyl-β-methylglycidyl ether.

A glycidyl monomer represented in the following general formula (1) is preferably used.

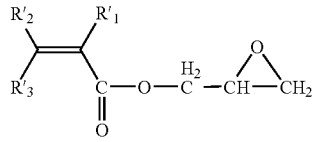

(1)

In the above general formula, $R'_1$, $R'_2$, and $R'_3$ each independently represent a hydrogen atom, an alkyl group, an aryl group, an aralkyl group, a carboxyl group, or an alkoxycarbonyl group.

An epoxy group-containing monomer can be obtained: by copolymerizing the monomers each having an epoxy group alone; or by mixing with a vinyl monomer to polymerize, with a polymerization method which is known in the art.

The epoxy group-containing vinyl resin preferably has a weight average molecular weight (Mw) of 3,000 to 40,000. If Mw is less than 3,000, even though the molecular weight increases in the production stage of the resin component, molecular chains of that are cleaved in high frequency in the kneading step and the effects on offset resistance may decrease. If Mw exceeds 400,000, the fixing ability of the toner may be affected. The Mw of the epoxy group-containing vinyl resin may be adjusted depending on, for example, the types of epoxy group-containing monomers, types of monomers that copolymerize therewith, and polymerization conditions.

Furthermore, the epoxy value of the epoxy group-containing vinyl resin is preferably 0.01 to 5.00 eq/kg. If the epoxy value is less than 0.01 eq/kg, the reaction in the production stage of the resin component hardly occurs and the amount of the production of a high-molecular weight resin component or THF-insoluble component is small, and hence, the effect on offset resistance may decrease. Further, the compatibilizing effect that is obtained from the combination with the polyester unit (II) formed by the monomers is hardly provided.

In addition, if the epoxy value of the epoxy group-containing vinyl resin exceeds 5.00 eq/kg, the resin establishes a cross-linking structure like a network structure, while the reaction in the production stage of the resin component easily occurs. Therefore, in the kneading step of the resin, molecular chains of the resin are cleaved in high frequency while the effect on offset resistance may decrease.

Furthermore, if the epoxy group-containing vinyl resin has an epoxy value of more than 5.00 eq/kg, the interaction between the epoxy group of the vinyl resin unit (I) and the carboxyl group of the polyester unit (II) are so strong that the resins tend to be in the state of being compatibilized with each other. In this case, the advantages of each of the vinyl resin unit (I) and the polyester unit (II), such as developing ability and fixing ability, cannot be utilized sufficiently. Thus, a decrease in image density, deterioration in fixing ability, or deterioration in offset resistance at high temperatures in continual use may occur.

Furthermore, in the production of toner, the resins are mixed with other raw materials while being compatibilized with each other. Thus, the shearing force is not sufficient to contribute to the dispersibilities of other raw materials, and hence, the dispersibilities of raw materials in toner particles may deteriorate. Besides, as the respective resins are in a state of being compatibilized with each other, the glass transition temperature as a toner may be decreased and the storage stability of the toner may deteriorate.

The epoxy value of the epoxy group-containing vinyl resin can be adjusted, for example, by considering the types and amounts of epoxy group-containing monomers to be used.

The epoxy group-containing vinyl resin may be mixed in the vinyl resin such that 0.05 to 5.00 mol of the epoxy group of the epoxy group-containing vinyl resin is included with respect to 1.00 mol of a carboxyl group in the carboxyl group-containing vinyl resin.

If the amount of mixed epoxy group-containing vinyl resin is less than 0.05 mol in terms of the epoxy group, the amount of the epoxy group in the binder resin is lower than that of the carboxyl group in the binder resin. Thus the number of the cross-linking points decreases and a cross-linking structure which exerts a sufficient effect on the offset resistance is hardly formed even in the case of mixing the epoxy group-containing vinyl resin in the binder resin. Furthermore, a kneading shearing force, which is caused by a cross-linking structure, cannot be applied at the time of melt-kneading in the production of toner particles. Therefore, the dispersibility of a raw material such as a mold-releasing agent, magnetic body, or charge control agent in toner particles deteriorates, which may affect the developing ability of the toner.

Furthermore, if the amount of the mixed epoxy group-containing vinyl resin is less than 0.05 mol in terms of the epoxy group, since many carboxyl groups remain in the binder resin, the carboxyl groups may affect the uniformity or durable stability of the charge of the toner. Further, the compatibility of two kinds of resins deteriorates owing to the existence of the remaining carboxyl groups in the binder resin and the carboxyl groups in the polyester unit (II). Therefore, the dispersibility of a raw material such as a mold-releasing agent, magnetic body, or charge control agent in toner particles deteriorates, which may affect the developing ability of the toner.

Furthermore, when the epoxy group-containing vinyl resin is mixed in an amount of more than 5.00 moles in terms of epoxy group, a cross-linking reaction between the carboxyl group and the epoxy group in the binder resin forms across-linking structure enough to affect the offset resistance. However, the distance between the cross-linking points narrows, thereby forming a network cross-linking structure. It means that molecular chains of the resin are cleaved in high frequency in the kneading step, and hence, the effectiveness of the offset resistance may be reduced.

Furthermore, when the epoxy group-containing vinyl resin is mixed in an amount of more than 5.00 moles in terms of epoxy group, the epoxy group of the vinyl resin unit (I) interacts with the carboxyl group of the polyester unit (II) so strong that the respective resins can be completely compatibilized with each other. In this case, those resins are mixed with other raw materials in the production of toner while those resin are in a state of being compatibilized with each other. Therefore, a sufficient shearing force enough to contribute to dispersibilities of other raw materials cannot be provided. As a result, the dispersibilities of raw materials in toner particles may deteriorate. In addition, as the resins become completely compatibilized with each other, the toner may have a decreased glass transition temperature, and hence, storage stability of the toner may be deteriorated.

A vinyl monomer to be copolymerized with an epoxy group-containing monomer are described below. Examples of the vinyl monomer include: styrene and styrene derivatives such as styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylene unsaturated monoolefins such as ethylene, propylene, butylene, and isobutylene; unsaturated polyenes such as butadiene; vinyl halides such as vinyl chloride, vinylidene chloride, vinyl bromide, and vinyl fluoride; vinyl esters such as vinyl acetate, vinyl propionate, and vinylbenzoate; α-methyl aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; acrylate or methacrylate derivatives such as acrylonitrile, methacrylonitrile, and acrylamide; and the above-mentioned α,β-unsaturated ester and dibasic diesters. At least one of them is used.

Among them, a combination of monomers to provide a styrene-acrylic copolymer or a styrene-methacrylic copolymer is preferable.

In the present invention, for the vinyl resin unit (I), an unit in which a carboxyl group-containing vinyl resin has been reacted with an epoxy group-containing vinyl resin in advance of production of the resin is preferably used. The method of reactions includes, (1) mixing the respective resins being melt and then heating in a reaction chamber to cause a cross-linking reaction, or (2) melt-kneading the respective resins under heat by means of a twin screw extruder or the like to cause a cross-linking reaction. It is noted that, for the generation of a vinyl resin having an extended distance between cross-linking points, it is preferable to cause a cross-linking reaction by melt-kneading under heat using a twin screw extruder or the like.

Furthermore, the polyester unit (II), which is one of the characteristic features of the present invention, has a main peak in a molecular weight region of 3,000 to 10,000, preferably 3,000 to 8,000 and a weight average molecular weight (Mw) of 3,000 to 15,000, preferably 4,000 to 12,000, when its molecular weight distribution is determined by GPC.

If the main-peak in molecular weight of the polyester unit (II) is less than 3,000, the toner may have poor blocking resistance. If the main-peak in molecular weight of the polyester unit (II) exceeds 10,000, the toner may have poor fixing ability. Furthermore, if the main-peak in molecular weight of the polyester unit (II) is less than 3,000, the interaction thereof with the epoxy group of the vinyl resin unit (I) having a specific epoxy value can be weakened. Thus, the dispersibilities of raw materials in toner particles may deteriorate, thereby causing a decrease in developing ability. A main-peak in molecular weight of the polyester unit (II) in excess of 10,000 is not preferable because the toner may have poor grindability in the production of toner even though the raw materials may be influenced by appropriate shearing force in the production of toner and have improved dispersibilities.

Furthermore, likewise, the toner may have poor blocking resistance when the weight average molecular weight (Mw) of the polyester unit (II) is less than 3,000. If the weight average molecular weight (Mw) of the polyester unit (II) exceeds 15,000, the fixing ability of the toner may be adversely affected. Furthermore, a weight average molecular weight (Mw) of the polyester unit (II) outside the range of 3,000 to 15,000 is not preferable because a balance between the dispersibilities of raw materials in toner particles and the grindability and developing ability of the toner deteriorates.

The main-peak in molecular weight and weight average molecular weight of the polyester unit (II) can be adjusted, for example, by considering the types of monomers that generate the polyester unit and the conditions of generating the polyester unit, or by thermal or mechanical process.

The typical polyester resin may be one having no endothermic peak. However, for the polyester unit (II), a polyester unit having an endothermic peak is generated by specifying the types of monomers used for the generation of such a unit. The polyester resin having an endothermic peak tends to be quickly melted at a certain temperature compared with the resin having no endothermic peak, and thus increases the fixing ability of the toner.

Furthermore, when the thermal properties of the polyester unit (II) are determined by means of a differential scanning calorimeter, the polyester unit (II) may have the maximum endothermic peak in a DSC curve in a temperature range of 50 to 100° C., preferably 60 to 100° C. If the polyester unit (II) has the maximum endothermic peak in the above temperature range, the toner not only has substantially improved fixing ability but also exerts an effect on compatibility with the vinyl resin unit due to the interaction with an epoxy group even if the polyester unit (II) is added in a small amount. If the maximum endothermic peak is placed at a temperature of lower than 50° C., the toner may have poor blocking resistance. If the maximum endothermic peak is placed at a temperature of higher than 100° C., the toner may be unable to exert effects on fixing ability and dispersibility.

Furthermore, the temperature at the maximum endothermic peak can be adjusted, for example, by considering the types of monomers that generate the polyester unit (II) and the conditions of generating the polyester unit (II), or by thermal or mechanical process. Furthermore, with respect to the state of compatibility between the vinyl resin unit (I) and the polyester unit (II) in the present invention, even if the polyester unit (II), which has an endothermic peak if used alone, is employed, it is preferable that the endothermic peak derived from the polyester unit (II) disappears when the unit is mixed with the vinyl resin unit (I).

Furthermore, the polyester unit (II) is preferably mixed with the vinyl resin unit (I) at a ratio equivalent to 0.01 to 10.00 moles of the carboxyl group of the polyester unit (II) per mole of the carboxyl group of the vinyl resin unit (I). As the polyester unit (II) is mixed with the vinyl resin unit (I) at a ratio within the above range, the polyester unit (II) can exert its compatibility with the vinyl resin unit (I) having an epoxy group more effectively.

If the mixing amount of the polyester unit (II) is less than 0.01 mole in terms of the carboxyl group thereof per mole of the carboxyl group of the vinyl resin unit (I), the compatibility of the polyester unit (II) with the vinyl resin unit (I) may deteriorate. As a result, the dispersibilities of the raw materials in toner particles may deteriorate. In addition, if the mixing amount of the polyester unit (II) is more than 10.00 moles in terms of the carboxyl group of the vinyl resin unit (I), the epoxy group of the vinyl resin unit interacts with the carboxyl group of the polyester unit so strong that the respective resins can be completely compatibilized with each other. In this case, those resins are mixed with other raw materials in the production of toner while those resin are in a state of being compatibilized with each other. Therefore, a sufficient shearing force enough to contribute to dispersibilities of other raw materials cannot be provided. As a result, the dispersibilities of raw materials in toner particles may deteriorate. In addition, as the resins become completely compatibilized with each other, the toner may have a decreased glass transition temperature and deteriorated storage stability.

In other words, the present invention controls the abundance ratio of the carboxyl group of the carboxyl group-containing vinyl resin, the carboxyl group of the polyester unit, and the epoxy group of the epoxy group-containing vinyl resin to be mixed in the binder resin component, thereby allowing the toner to exert the effect of compatibility between the polyester unit and the epoxy group-containing vinyl resin. As a result, a uniformly charged toner having excellent performance stability as well as excellent dispersibility of raw materials including a magnetic body, a pigment, and a dye in toner particles, while preventing those raw materials from falling out of the toner particles can be obtained.

Hereinafter, components for obtaining the polyester unit (II) used in the present invention will be concretely described. It is preferable that acid-alcohol components used in the preparation of a polyester unit include 45 to 55 mol % of an alcohol component and 55 to 45 mol % of an acid component in whole components.

The polyester unit (II) used in the present invention, as described above, is a polyester unit formed by a condensation polymerization of monomers each including at least aliphatic dicarboxylic acid having 4 to 12 carbon atoms, aromatic tricarboxylic acid, and ethylene glycol. Examples of aliphatic dicarboxylic acid having 4 to 12 carbon atoms include succinic acid, adipic acid, and sebacic acid. Examples of aromatic tricarboxylic acid include 1,2,4-benzenetricarboxylic acid and 1,2,5-benzenetricarboxylic acid. In addition, each of the aliphatic dicarboxylic acid and the aromatic tricarboxylic acid may be an anhydride thereof.

The amount of the aromatic tricarboxylic acid used is preferably 1 to 25 mol %, more preferably 1 to 15 mol % of the whole acid components used in the production of polyester unit. The total amount of aliphatic dicarboxylic acid having 4 to 12 carbon atoms and aromatic tricarboxylic acid is preferably 70 to 100 mol %, more preferably 80 to 100 mol % of the whole acid components used in the production of polyester unit. Acids other than aliphatic dicarboxylic acid and aromatic tricarboxylic acid which may be used in the present invention include any of those which can be used in the production of polyester.

The alcohol components include, in addition to ethylene glycol, aliphatic alcohols such as propylene glycol, 1,3-butane diol, 1,4-butane diol, 2,3-butane diol, diethylene glycol, triethyleneglycol, 1,5-pentanediol, 1,6-hexanediol, neopentyl glycol, and 2-ethyl-1,3-hexane diol. Using any of those aliphatic alcohols is preferable to improve the compatibility with the epoxy group-containing vinyl resin unit (I).

The total amount of ethylene glycol used is preferably 60 to 100 mol %, more preferably 70 to 95 mol % of the whole alcohol components used in the production of polyester unit.

Furthermore, the total amount of the three kinds of monomers (i.e., aliphatic dicarboxylic acid having 4 to 12 carbon atoms, aromatic tricarboxylic acid, and ethylene glycol) is preferably 80 mol % or more, more preferably 90 mol % or more of the whole components including acids and alcohols used in the production of polyester unit.

Furthermore, as a method of producing the polyester unit (II), the polyester unit (II) can be produced by a typical dehydration condensation reaction. In contrast, for more effectively exerting the interaction with an epoxy group, a more effective process is the addition of tricarboxylic acid for allowing the molecular chain of the polyester unit to be branched over a period from the middle state to the late state of the reaction of aliphatic polyester.

Furthermore, the acid value of the polyester unit (II) is preferably in the range of 0.1 to 20.0 mg KOH/g. If the polyester unit (II) has an acid value of less than 0.1 mg KOH/g, the compatibility between the vinyl resin unit and the polyester unit may deteriorate and the dispersibilities of raw materials in toner particles may deteriorate.

Furthermore, if the polyester unit has an acid value of more than 20.0 mg KOH/g, the interaction between the epoxy group of the vinyl resin unit and the carboxyl group of the polyester unit so strong that the resins are completely compatibilized with each other. In this case, those resins are mixed with other raw materials in the production of toner while those resins are in a state of being compatibilized with each other. Therefore, a sufficient shearing force enough to contribute to dispersibilities of other raw materials cannot be provided. As a result, the dispersibilities of raw materials in toner particles may deteriorate. In addition, as the resins become completely compatibilized with each other, the toner may have a decreased glass transition temperature and deteriorated storage stability. Furthermore, if the polyester unit has an acid value of more than 20.0 mg KOH/g, the negative charging property of the binder resin in toner particles becomes stronger when the toner of the present invention is one having a positive charging property. As a result, a decrease in image density and an increase in fogging tend to occur.

In addition, the toner of the present invention may contain a copolymer having an aliphatic conjugated diene compound as a monomer unit. Containing such an elastic copolymer having a relatively long chain can facilitate the generation of a tangled structure in the production of toner. Furthermore, if the monomer unit is incorporated into such a network structure, it becomes possible to extend an empty space spatially, thereby obtaining a pseudo-cross-linking component having good elasticity even though the unit has a small molecular weight.

The aliphatic conjugated diene compound to be preferably used includes one having a main peak in a molecular weight region of 8,000 to 50,000 and a weight average molecular weight of 50,000 to 500,000.

A copolymer, which contains the aliphatic conjugated diene compound as a monomer unit, may be contained in a binder resin in an amount of 30% by mass or less. If the amount of the copolymer to be added exceeds 30% by mass, an increase in softening point of the binder resin occurs, and hence, the toner may hardly attain its favorable fixing ability. When the copolymer is added, a desired effect can be obtained if the copolymer is contained in an amount of 10% by mass or more.

Examples of a monomer of an aliphatic conjugated diene compound constituting the copolymer include 1,3-butadiene, 2-methyl-1,3-butadiene, 2-ethyl-1,3-butadiene, 2-phenyl-1,3-butadiene, 2,3-dimethyl-1,3-butadiene, 1,4-diphenyl-1,3-butadiene, 1,1,4,4,-tetraphenyl-1,3-butadiene, 1,3-pentadiene, 2-methyl-1,3-pentadiene, 2-ethyl-1,3-pentadiene, 3-methyl-1,3-pentadiene, 4-methyl-1,3-pentadiene, 1,3-hexadiene, 2,4-hexadiene, 2,3-dimethyl-1,3-hexadiene, 2,5-dimethyl-2,4-hexadiene, 1,3-heptadiene, 2,4-heptadiene, 2,3-dimethyl-1,3-heptadiene, 1,3-octadiene, 2,4-octadiene, 2,3-dimethyl-1,3-octadiene, 3,4-diethyl-1,3-octadiene, 1,3-nonadiene, 2,4-nonadiene, and 2,3-dimethyl-1,3-nonadiene, and derivatives thereof.

The copolymer can be obtained by copolymerizing monomers of the aliphatic conjugated diene compound with at least one of the following vinyl monomers. Examples of the vinyl monomer include: styrene and styrene derivatives such as styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylene unsaturated monoolefins such as ethylene, propylene, butylene, and isobutylene; unsaturated polyenes such as butadiene; vinyl halides such as vinyl chloride, vinylidene chloride, vinyl bromide, and vinyl fluoride; vinyl esters such as vinyl acetate, vinyl propionate, and vinyl benzoate; α-methyl aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; acrylate or methacrylate derivatives such as acrylonitrile, methacrylonitrile, and acrylamide; and the above-mentioned α,β-unsaturated ester and dibasic diesters. Among them, styrene or a styrene derivative is used as a vinyl monomer, 1,3-butadiene, 2-methyl-1,3-butadiene, or 1,3-pentadiene is used as a conjugated diene compound, and a combination of them are preferably used for copolymerization.

It is preferable that the monomers be subjected to copolymerization in such a manner that a ratio (component derived from a styrene monomer/an aliphatic conjugated diene compound) is 65/35 to 98/2. An amount of the component derived from the styrene monomer of less than 65% by mass is not preferable because a decrease in glass transition temperature of the copolymer leads to deteriorate the storage stability of toner. In addition, an amount in excess of 98% by mass is not preferable because the fixing ability of toner deteriorates as the glass transition temperature increases.

Hereinafter, measuring methods for the physical properties according to the present invention will be described bellow.

[Measurement of THF-Insoluble Component]

A toner sample of about 1.0 g is weighed (W1 g) and placed in filter paper thimble (e.g., No. 86R size 28×100 mm, manufactured by Toyo Roshi Co., Ltd.) and then subjected to a Soxhlet extractor for extraction for 16 hours using 200 ml of THF as a solvent. At this time, the extraction is conducted under a reflux cycle of once per about 4 to 5 minutes. After completion of the extraction, the filter paper thimble is removed and dried at 40° C. for 8 hours under vacuum, followed by weighing an extraction residue (W2 g).

Subsequently, the incinerated remaining ash fraction in the toner is weighed (W3 g). The mass of incinerated remaining ash fraction is obtained by the following procedures. About 2 g of the sample is placed in a 30-ml magnetic crucible previously weighed in a precise manner, and the total mass is precisely weighed, and the mass (Wa g) of the sample which is toner is determined by subtracting the mass of the crucible. The crucible is placed in an electric furnace and heated at about 900° C. for about 3 hours. After that, the sample is cooled down in the electric furnace and then left alone in a desiccator to be cooled down at room temperature for 1 hour or more. Subsequently, the mass of the crucible containing an incinerated remaining ash fraction is precisely weighed. The mass of the incinerated remaining ash fraction (Wb g) is determined by subtracting the mass of the crucible from the mass of the crucible containing an incinerated remaining ash fraction.

$$(Wb/Wa)\times 100=\text{Incinerated remaining ash fraction content (mass \%)} \qquad \text{Formula 1}$$

Using the fraction content, the mass (W3 g) of the incinerated remaining ash fraction in the sample W1 g can be determined.

The THF-insoluble component can be determined from the following formula.

$$\text{THF-insoluble component (mass \%)}=\{(W2-W3)/(W1-W3)\}\times 100\% \qquad \text{Formula 2}$$

In addition, the THF-insoluble component of a sample that does not contain any component other than resins including a binder resin can be determined by the following formula, in which the resin is weighted to a specified amount (W1 g) and then the remaining amount thereof after extraction (W2 g) is obtained in the same steps.

$$\text{THF-insoluble component (mass \%)}=(W2/W1)\times 100 \qquad \text{Formula 3}$$

[Determination of Molecular Weight Distribution by GPC]

The sample is put in THF, and is left for several hours, followed by being thoroughly shaken so as to be well mixed with the THF (until coalescent matter of the sample disappears), which is further left for at least 12 hours. Here, the sample is left to stand in THF for at least 24 hours. Thereafter, the solution having been passed through a sample-treating filter (pore size: 0.2 to 0.5 μm; for example, MAISHORIDISK H-25-2, available from TOSOH CORPORATION may be used) is used as the sample for GPC. The sample is also adjusted to have resin components in a concentration from 0.5 to 5.0 mg/ml.

A column is stabilized in a heat chamber at 40° C. Then, THF provided as a solvent is flowed into the column at that temperature at a flow rate of 1 ml/min. About 100 μl of the GPC sample that is a THF sample solution is introduced into the column for the measurement.

A detector used is an RI (index of refraction) detector. Further, the column may be a combination of commercially available two or more polystyrene gel columns. The combination includes a combination of Shodex GPC KF-801, 802, 803, 804, 805, 806, 807, and 800P, manufactured by SHOWA DENKO K.K., or a combination of TSK gel G1000H($H_{xL}$), G2000H($H17_{xL}$), G3000H($H_{xL}$), G4000H($H_{xL}$), G5000H($H_{xL}$), G6000H($H_{xL}$), G7000H($H_{xL}$), and TSK guard column, manufactured by TOSOH CORPORATION.

In measuring the molecular weight of the sample, the molecular weight distribution of the sample is calculated from the relationship between the logarithmic values of a calibration curve prepared using several kinds of monodisperse polystyrene standard samples and the value of count. The standard polystyrene samples used for the preparation of the calibration curve include the samples with molecular weights of 100 to 10,000,000, which are available from, e.g., TOSOH CORPORATION or SHOWA DENKO K.K. It is suitable to use at least about 10 standard polystyrene samples.

Depending on the method described above, we can determine the molecular weight distribution of the toner, the molecular weight distribution of the carboxyl group-containing vinyl resin (the above high-molecular weight resin component and the above low-molecular weight resin component), the weight average molecular weight of the epoxy group-containing vinyl resin, the molecular weight distribution and weight average molecular weight of the polyester unit, and the main-peak in molecular weight, weight average molecular weight, and number average molecular weight of any of other resin compounds, respectively.

A ratio of the surface area of the THF-soluble component with respect to a molecular weight of 100,000 or less in a chromatogram obtained by the above method can be determined by measuring the surface area of a region surrounded by a detection line obtained from a detected value, a base line, and a desired molecular weight value with any of conventional methods.

[Measurement of Epoxy Value]

Basic procedures are based on JIS K-7236.

1) 0.5 to 2.0 g of a sample is weighed and the weight of a resin is determined as W (g).

2) The sample is placed in a 300-ml beaker and dissolved in 10 ml of chloroform and 20 ml of acetic acid.

3) In this solution, 10 ml of a tetraethylammonium bromide in acetic acid is added.

4) Using a 0.1 mol/l acetic hyperchloride solution, titration is performed by a potentiometric titration apparatus (e.g., automatic titration using a potentiometric titration apparatus AT-400 (Win Workstation) manufactured by Kyoto Electronics Manufacturing Co., Ltd. and ABP-410 Electric burette can be applied).

5) The amount of the acetic hyperchloride solution used at this time is determined as S ml. Simultaneously a blank is measured, and the amount of the acetic hyperchloride solution used at this time is determined as B ml.

6) The epoxy value is calculated using the following formula. In the formula, "f" is a factor of the acetic hyperchloride solution.

$$\text{Epoxy value (eq/kg)} = 0.1 \times f \times (S-B)/W \qquad \text{Formula 4}$$

[Measurement of Acid Value]

Basic procedures are based on JIS K-0070.

1) The ground product of the sample, 0.5 to 2.0 (g) is weighed precisely and the weight of the sample is determined as W (g).

2) The sample is placed in a 300-ml beaker and a 150-ml mixture of toluene/ethanol (4/1) is added to dissolve the sample.

3) Using a 0.1 N solution of KOH in methanol, titration is performed by means of a potentiometric titration device (e.g., automatic titration using a potentiometric titration device AT-400 (Win Workstation) manufactured by Kyoto Electronics Manufacturing Co., Ltd. and ABP-410 Electric burette can be applied).

4) The amount of the KOH solution used at this time is determined as S ml. Simultaneously a blank is measured, and the amount of the KOH solution used at this time is determined as B ml.

5) The acid value is calculated using the following formula. In the formula, "f" is a factor of KOH.

$$\text{Acid value (mgKOH/g)} = ((S-B) \times f \times 5.61)/W \qquad \text{Formula 5}$$

The acid values of the carboxyl group-containing vinyl resin, the high-molecular weight resin component, the low-molecular weight resin component, and the polyester unit can be determined on the basis of the above methods, respectively.

[Determination of Maximum Endothermic Peak in DSC Curve]

Measurement is carried out according to ASTM D3418-82, using a differential scanning calorimeter (DSC measuring instrument), for example, DSC-7, manufactured by Perkin-Elmer Corporation, or DSC2920 manufactured by TA Instruments Japan Co., Ltd.

A sample for measurement is precisely weighed in an amount of 5 mg. This sample is put in a pan made of aluminum and an empty aluminum pan is used as reference. Measurement is made at a heating rate of 10° C./min within the measurement temperature range of 30° C. to 200° C. In the course of this heating, a DSC curve is obtained in the temperature range of 60° C. to 200° C. The temperature at which the top of a peak is placed is read from the DSC curve to obtain the maximum endothermic peak.

In addition, depending on the above method, the Tg value of the carboxyl group-containing vinyl resin and the melting point of wax can be determined.

In the present invention, the binder resin component may be prepared, for example, by mixing (blending) the vinyl resin unit with the polyester unit. The binder resin component may be a component generated by mixing the vinyl resin unit with the polyester unit before the production of toner or may be a component generated by mixing with other toner materials at the time of production of toner.

It is possible that the binder resin used in the present invention is added with any one of the following polymers in addition to the foregoing components. These polymers may be used at a ratio of 30 mass % or less in the binder resin with respect to the total amount of the polymer and an aliphatic conjugated diene compound.

Examples thereof include: homopolymers of styrene and derivatives thereof such as polystyrene, poly-p-chlorostyrene, and polyvinyltoluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-α-methyl chloromethacrylate copolymer, a styrene-acrylonitrile copolymer, a styrene-vinylmethylether copolymer, a styrene-vinylethylether copolymer, a styrene-vinylmethylketone copolymer, and a styrene-acrylonitrile-indene copolymer; polyvinyl chloride; a phenol resin; a natural modified phenol resin; a natural resin modified maleic acid resin; an acrylic resin; a methacrylic resin; polyvinyl acetate; a silicone resin; polyurethane; a polyamide resin; a furan resin; an epoxy resin; a xylene resin; polyvinyl butyral; a terpene resin; a coumarone-indene resin; and a petroleum resin.

The colorants, which can be used in the toner of the present invention, include any appropriate pigments or dyes. Examples of the pigments include carbon black, aniline black, acetylene black, naphthol yellow, Hansa yellow, rhodamine lake, arizaline lake, colcothar, phthalocyanine blue, and indanthrene blue. Each of them may be used in an amount required for keeping an optical density of a fixed image. That is, the amount of them to be added is 0.1 to 20 parts by mass, preferably 0.2 to 10 parts by mass with respect to 100 parts by mass of the binder resin.

Further, dyes may also be used for the colorants. Examples of the dyes include azo, anthraquinone, xanthene, and methine dyes. Each of them is added in an amount of 0.1 to 20 parts by mass, preferably 0.3 to 10 parts by mass with respect to 100 parts by mass of the binder resin.

In the toner of the present invention, magnetic iron oxide may be used as a colorant so that the toner is used as a magnetic toner.

Further, a number average particle size of magnetic iron oxide (D1) is preferably 0.05 to 1.0 μm, more preferably 0.1 to 0.6 μm.

In addition, particles in any forms may be used while the magnetic iron oxide used in the present invention is preferably magnetic iron oxide particles in the form of an octahedral or multinuclear form in terms of the dispersibility of magnetic iron oxide in the toner particles. These particles may be used alone or in combination.

Here, the term "multinuclear form" refers to a form obtained by crystal growth from a plurality of particle nucleus as described in JP 11-153882 A (U.S. Pat. No. 6,653,036), or a form obtained by crystal growth from a small particle nucleus on a core particle to form a protruded portion consisting of the surface and the edge of a particle.

The number average particle size of the magnetic iron oxide can be obtained, for example, by determining a photograph taken at a magnifying power of 40,000 times on a transmission electron microscope, where 250 particles of the magnetic iron oxide are picked up at random to determine a Martin diameter (length of a line segment that divides a projection image area in half in the predetermined direction). The particle form of the magnetic iron oxide can be determined by, for example, the observed image of magnetic iron oxide particles obtained by means of transmission electron microscope.

In the present invention, the amount of magnetic iron oxide to be contained in the toner is 10 to 200 parts by mass, preferably 20 to 170 parts by mass, more preferably 30 to 150 parts by weight in terms of, for example, transferring toner and exerting a sufficient tinctorial power on a fixing image upon development.

The toner of the present invention may preferably contain a charge control agent to maintain positive or negative chargeability.

Substances that control the toner to be positively chargeable include: modified substances due to nigrosin, fatty acid metallic salts, and the like; tributylbenzyl ammonium-1-hydroxy-4-naphtho sulfonate; quaternary ammonium salts such as tetrabutyl ammonium tetrafluoroborate, analogues thereof, onium salt, such as phosphonium salt and lake pigments thereof; triphenyl methane dyes, and lake pigments thereof (such as phosphotungstic acid, phosphomolybdic acid, phosphotungsten-molybdic acid, tannic acid, lauric acid, gallic acid, ferricyanide, or ferrocyanide); metal salt of higher fatty acid; diorganotin oxides such as such as dibutyl tin oxide, dioctyl tin oxide, and dicyclohexyl tin oxide; diorganotin borate such as dibutyl tin borate, dioctyl tin borate, and dicyclohexyl tin borate; guanidine compound; and imidazole compounds, which may be provided individually or in combination with two or more. Among them, a triphenyl methane compound, an imidazole compound and quaternary ammonium salt in which halogen is not a counter ion are preferably used.

Furthermore, as charge control agents for controlling toner to be negatively chargeable, there are substances as described bellow. For instance, an organic metal complex or chelating agent is preferable. The charge control agents include a monoazo metal complex, an acetyl acetone metal complex, an aromatic hydroxy carboxylic acid metal complex, and an aromatic dicarboxylic acid metal complex. Additionally, there are aromatic hydroxy carboxylic acid, aromatic monocarboxylic acid, aromatic polycarbonic acid, and metallic salts, anhydrides, esters thereof, and phenol derivatives (such as bisphenol).

Examples of a method of allowing the toner to contain a charge control agent include internal addition to the toner particles and external addition of charge control agent to the toner particles. The present invention employs any method depending on kinds of charge control agent of the present invention. The amount of the charge control agent used can be, but not specifically limited to, determined depending on kinds of the other binder resin, the presence or absence of other additives, and a toner-producing method including dispersion method, or the like. Besides, the charge control agent is used at an amount of 0.1 to 10 parts by mass, more preferably 0.1 to 5 parts by mass with respect to 100 parts by mass of the binder resin.

In the present invention, it is preferable that the toner contain any kind of wax as listed below to provide the toner with mold release characteristics. Examples of wax used in the present invention include: aliphatic hydrocarbon wax such as low-molecular weight polyethylene, low-molecular weight polypropylene, polyolefin copolymer, polyolefin wax, microcrystalline wax, paraffin wax, and Fischer-Tropsch wax; oxides of aliphatic hydrocarbon wax such as oxide polyethylene wax or block copolymers thereof; plant wax such as candelilla wax, carnauba wax, haze wax, and jojoba wax; animal wax such as bees wax, lanoline, and spermaceti wax; mineral wax such as ozocerite, ceresin, and petrolatum; wax mainly containing fatty acid ester, such as montanic acid ester wax and caster wax; and wax in which part or whole of fatty acid ester is deoxidized, such as dioxidized carnauba wax. Furthermore, wax may be any of: saturated straight-chain fatty acids such as palmitic acid, stearic acid, montanic acid, and long-chain alkyl carboxylic acid having a long chain alkyl group; unsaturated fatty acids such as brassidic acid, eleostearic acid, and parinaric acid; saturated alcohols such as stearyl alcohol, eicosyl alcohol, behenyl alcohol, carnaubyl alcohol, ceryl alcohol, melissyl alcohol, and long-chain alkyl alcohol having a long-chain alkyl group; polyalcohols such as sorbitol; aliphatic amides such as linoleic acid amide, oleic acid amide, and lauric acid amide; saturated fatty acid bis-amides such as methylene bis-stearic acid amide, ethylenebis-caprinic acid amide, ethylenebis-lauric acid amide, and hexamethylene bis-stearic acid amide; unsaturated fatty acid amides such as ethylene bis-oleic acid amide, hexamethylene bis-oleic amide, N,N'-dioleyl adipic acid amide, and N,N'-dioleyl sebacic amide; aromatic bis-amides such as m-xylene bis-stearic acid amide and N,N'-distearyl isophthalic amide; fatty metallic salts such as calcium stearate, calcium laurate, zinc stearate, and magnesium stearate (typically referred to as a metallic soap); wax in which vinyl monomers such as styrene and acrylic acid are grafted in aliphatic hydrocarbon wax; partially esterified products of fatty acid such as behenylic acid monoglyceride and polyalcohol; and methyl ester compounds having hydroxyl groups which can be obtained by hydrogenation of a vegetable oil.

Examples of waxes preferably usable include: polyolefin obtained by radical polymerization of olefin under a high pressure; polyolefin obtained by purification of a low-molecular weight by-product obtained upon polymerization of high molecular weight polyolefin; polyolefin polymerized using a Ziegler or metallocene catalyst or any other catalyst under a low pressure; polyolefin polymerized by utilizing radial ray, electromagnetic wave, or light; low-molecular weight polyolefin obtained by thermal decomposition of high molecular polyolefin; paraffin wax, microcrystalline wax, and Fischer-Tropsch wax; synthetic hydrocarbon wax synthesized using, for example, Dindol, Hydrocol, or Arge process; synthesized wax using a compound having one carbon atom as a monomer and wax composed of alkyl compounds having a functional group such as a hydroxyl group or a carboxyl group; a mixture of hydrocarbon wax and wax having a functional group; and wax in which a vinyl monomers such as styrene, malate, acrylate, methacrylate, and maleic anhydride are subjected to a graft modification using the wax as a core.

Furthermore, these kinds of wax are subjected to a press-sweating method, solvent method, re-crystallization method, vacuum distillation method, supercritical gas extraction, or melt liquid crystalline process, and the resulted one having a sharp molecular weight distribution and one removing low-molecular weight solid fatty acid, low-molecular weight solid alcohol, a low-molecular weight solid compound, and other impurities are preferably used.

The amount of the wax added is preferably 0.1 to 20 parts by mass, more preferably 1 to 10 parts by mass with respect to 100 parts by mass of the binder resin in terms of attaining both the mold-releasing characteristics of the toner and the high quality of a fixed image, for example. In addition, two or more different kinds of wax may be used together.

The toner added to the wax is preferably one having the maximum peak in a temperature range of 60 to 120° C. in an endothermic curve measured by DSC (differential scanning calorimetry). When the toner has the maximum endothermic peak in the above temperature range, the toner has good fixing ability and also good offset resistance. When the toner has the maximum endothermic peak in the temperature range of lower than 60° C., storage stability of the toner itself may deteriorate owing to the plasticizing effect of wax. If the maximum endothermic peak is placed in a region exceeding 120° C., the toner may have poor fixing ability. Besides, the maximum endothermic peak can be adjusted, for example, by considering the type of wax used. The maximum endothermic peak can be determined by the same way as that of the maximum endothermic peak of the polyester unit (II).

The toner of the present invention is preferably further added with silica fine particles to improve its charging stability, developing ability, fluidity, and durability.

The silica fine particles used in the present invention each having a specific surface area of 30 $m^2/g$ or more, particularly 50 to 400 $m^2/g$ determined by the BET method with nitrogen adsorption provide favorable property. The amount of the silica fine particles used is preferably 0.01 to 8.00 parts by mass, preferably 0.10 to 5.00 parts by mass with respect to 100 parts by mass of the toner. The BET specific surface area of the silica fine particles may be determined using, for example, a specific surface area measuring device AUTOSOBE 1 (manufactured by Yuasa Ionics Co.), GEMINI 2360/2375 (manufactured by Micrometric, Co.), and TRYSTAR 3000 (manufactured by Micrometric, Co.) such that nitrogen gas is adsorbed on each surface of the silica fine particles and the specific surface area can be then calculated by the BET multi-point method.

For the purpose of controlling the charging property of toner, hydrophobicity, and the like, if needed, native silicone varnish, various kinds of modified silicone varnish, native silicone oil, various kinds of modified silicone oil, a silane-coupling agent, silane-compounds having functional groups, other organic silicon compounds, and the like may be preferably used for the silica fine particles to be used in the present invention, independently or in combination.

The toner of the present invention may be added with other external additives if necessary. Such external additives include a resin fine particle, an inorganic fine particle, or the like which acts as an charge aiding agent, a conductivity-imparting agent, a flowability-imparting agent, caking preventing agent, mold-releasing agent used in thermal roller fixation, lubricant, and abrasive.

For instance, polyfluoroethylene powder, zinc stearate powder, or polyvinilidene fluoride powder is preferable as the lubricant. Among them, polyvinilidene fluoride is preferable.

In addition, examples of the abrasive include cerium oxide powder, silicon carbide powder, and strontium titanate powder. Among them, the preferable abrasive is strontium titanate powder.

Examples of the flowability-imparting agent include titanium oxide powder and aluminum oxide powder. Among them, one subjected to a hydrophobic treatment is preferable.

Examples of the conductivity-imparting agent include carbon black powder, zinc oxide powder, antimony oxide powder and tin oxide powder.

Furthermore, small amounts of white and black fine particles, which have opposite polarities with respect to each other, may be used as an improving agent for the developing ability.

The toner of the present invention can be obtained by: mixing a binder resin, a colorant, and other additives sufficiently by means of a mixer such as a Henschel mixer or a ball mill; melt-kneading the resultant using a thermal kneader such as a heating roller, kneader, or extruder; cooling and solidifying the resultant; grinding using a grinder; classifying the resultant using a classifier; and further mixing a desired additive sufficiently with the above components by means of a mixer such as a Henschel mixer if required. A known apparatus may be used in the manufacturing of the toner of the present invention.

Examples of the mixer include: Henschel mixer (manufactured by Mitsui Mining Co., Ltd.); Super mixer (manufactured by Kawata Mfg. Co., Ltd.); Ribocone (manufactured by Okawara Mfg. Co., Ltd.); Nauta mixer, Turbulizer, and Cyclomix (manufactured by Hosokawa Micron Corporation); Spiral pin mixer (manufactured by Pacific Machinery & Engineering Co., Ltd.); and Redige mixer (manufactured by Matsubo Corporation).

Further, examples of the kneader include: KRC kneader (manufactured by Kurimoto, Ltd.); Buss-Co-Kneader (manufactured by Coperion BUSS AG); TEM extruder (manufactured by Toshiba Machine Co., Ltd.); TEX twin screw kneader (manufactured by Japan Steel Works, Ltd.); PCM kneader (manufactured by Ikegai, Ltd.); Three roll mill, Mixing roll mill, and Kneader (manufactured by Inoue-Nissei Engineering Pte., Ltd.); Kneadex (manufactured by Mitsui Mining Co., Ltd.); MS type pressurizing kneader and Kneader ruder (manufactured by Moriyama Co., Ltd.); and Banbury mixer (manufactured by Kobe Steel, Ltd.).

Further, examples of a pulverizer include: Counter jet mill, Micron jet, and Inomizer (manufactured by Hosokawa Micron Corporation); IDS type mill and PJM jet pulverizer (manufactured by Nippon Pneumatic Mfg. Co., Ltd.); Cross-jet Mill (manufactured by Kurimoto, Ltd.); Ulmax (manufactured by Nisso Engineering Co., Ltd.); SK Jet-O-Mill (manufactured by Seisin Enterprise Co., Ltd.); Cliptron (manufactured by Kawasaki Heavy Industries, Ltd.); Turbo Mill (manufactured by Turbo Kogyo Co., Ltd.); and Super Rotor (manufactured by Nisshin Engineering Inc.).

Further, examples of the classifier include: Classiel, Micron Classifier, and Spedic Classifier (manufactured by Seisin Enterprises Co., Ltd.); Turbo Classifier (manufactured by Nisshin Engineering Co., Ltd.); Micron separator, Turboplex (ATP), and TSP Separator (manufactured by Hosokawa Micron Co., Ltd.); Elbow-Jet (manufactured by Nittetsu Mining Co., Ltd.); Dispersion Separator (manufactured by Japan Pneumatic Co., Ltd.); and YM Microcut (manufactured by Yasukawa Electric Co., Ltd.).

Further, examples of a screening device for sifting coarse particles and the like include: Ultra Sonic (manufactured by Koei Sangyo Co., Ltd.); Resona Sieve and Gyro Sifter (manufactured by Tokuju Corporation); Vibrasonic System (manufactured by Dalton Corporation); Soniclean (manufactured by Sinto Kogyo Co., Ltd.) Turbo Screener (manufactured by Turbo Kogyo Co., Ltd.); Micro Sifter (manufactured by Makino Mfg. Co., Ltd.); and Circular Oscillation Sieve.

EXAMPLES

Hereinafter, the present invention will be described concretely with reference to the following examples. However, these examples will not intend to restrict the embodiments of the present invention. In the examples, the term "parts" means "parts by mass" unless otherwise specified.

Production Example of Low-Molecular-Weight Resin Component (B-1)

In a four-necked flask, 300 parts by mass of xylene was introduced and then the inside of the flask was sufficiently replaced with nitrogen while being stirred, followed by warming up for reflux.

Under the reflux, a mixture solution of 78 parts by mass of styrene, 22 parts by mass of n-butyl acrylate, and 2.5 parts by mass of polymerization initiator 1 (di-tert-butylperoxide, a temperature such that the half life there of is 10 hours: 123.7° C.) was dropped into the flask over 4 hours, followed by keeping the reaction mixture as it is for 2 hours to complete polymerization. Consequently, a solution containing a low-molecular-weight resin component (B-1) was obtained. The main-peak in molecular weight (MpL) of the low-molecular-weight resin component (B-1) was 12,700 and the glass transition temperature was 60.8° C. The physical properties of the low-molecular-weight resin component (B-1) are shown in Table 2.

Production Example of Low-Molecular-Weight Resin Component (B-2)

Polymerization was performed by the same process as in the Production Example of the low-molecular-weight resin component (B-1) using 80 parts by mass of styrene, 20 parts by mass of n-butyl acrylate, and 2 parts by mass of polymerization initiator 1 to obtain a solution containing a low-molecular-weight resin component (B-2). The physical properties of the low-molecular-weight resin component (B-2) are shown in Table 2.

Production Example of Low-Molecular Weight Resin component (B-3)

Polymerization was performed by the same process as in the Production Example of the low-molecular-weight resin component (B-1) using 70 parts by mass of styrene, 20 parts by mass of n-butyl acrylate, 10 parts by mass of n-monobutyl maleate, 0.005 part by mass of divinyl benzene, and 1 part by mass of polymerization initiator 1, thereby obtaining a solution containing a low-molecular weight resin component (B-3). The physical properties of the low-molecular weight resin component (B-3) are shown in Table 2.

Production Example of High-Molecular-Weight Resin Component (A-1)

In a four-necked flask, 300 parts by mass of xylene was introduced. Then, the inside of the flask was sufficiently replaced with nitrogen while being stirred, followed by rising the temperature for reflux.

Under the reflux, at first, a mixture solution of 82 parts by mass of styrene, 15 parts by mass of n-butyl acrylate, and 0.8 parts by mass of polymerization initiator 2 (2,2-bis(4,4-di-tert-butyl peroxycyclohexyl) propane, a temperature such that the half life thereof is 10 hours: 92° C.) was dropped into the flask over 4 hours. When the mixture solution was dropped for 2 hours, a mixture of 3 parts by mass of methacrylic acid and 0.2 part by mass of polymerization initiator 2 was dropped into the flask over 2 hours. After the solutions had been dropped completely, the mixture was retained for 3 hours to complete polymerization, thereby obtaining a solution containing a high-molecular weight resin component (A-1). The main-peak in molecular weight (MpH) of the high-molecular weight resin component (A-1) was 210,000, the glass transition temperature was 59.8° C., and the measured acid value was 18.9 mg KOH/g. The physical properties of the high-molecular weight resin component (A-1) are shown in Table 2.

As described above, monomers having no carboxyl groups were polymerized in advance and a resin having no acid value was produced, followed by dropping monomers having carboxyl groups to carry out polymerization. Consequently, the resin having carboxyl groups with a certain distance between carboxyl groups can be produced. The use of such a resin allows the production of a vinyl resin unit having a long distance between cross-linking points when reacted with a vinyl resin containing an epoxy group.

Production Example of High-Molecular Weight Resin Component (A-2)

Like Production Example of the high-molecular weight resin component (A-1), 70 parts by mass of styrene, 25 parts by mass of n-butyl acrylate, 5 parts by mass of methacrylic acid, and 1.5 parts by mass of polymerization initiator 2 were used to obtain a solution containing a high-molecular weight resin component (A-2). The physical properties of the high-molecular weight resin component (A-2) are shown in Table 2.

Production Example of High-Molecular Weight Resin Component (A-3)

In a four-necked flask, 180 parts by mass of degassed water and 20 parts by mass of a 2 mass % aqueous solution of polyvinyl alcohol were introduced. Then, the flask was added with a mixture solution of 70 parts by mass of styrene, 25 parts by mass of n-butyl acrylate, 5 parts by mass of mono-n-butyl maleate, 0.005 part by mass of divinyl benzene, and 0.1 part by mass of polymerization initiator 2, and the whole was stirred to obtain a suspension.

The inside of the flask was sufficiently replaced with nitrogen and then warmed up to 85° C. to initiate polymerization. The reaction mixture was left standing at this temperature for 24 hours and then added with 0.1 part by mass of benzoyl peroxide (a temperature such that the half life thereof is 10 hours: 72° C.). Subsequently, the reaction mixture was further left standing for 12 hours to complete polymerization. After that, the high-molecular-weight polymer was isolated by filtration, washed with water, and then dried. Consequently, a high-molecular weight resin component (A-3) was obtained. The physical properties of the high-molecular weight resin component (A-3) are shown in Table 2.

Production Example of Glycidyl Group-Containing Vinyl Resin (G-1)

In a four-necked flask, 300 parts by mass of xylene was, added. Then, the inside of the flask was sufficiently replaced with nitrogen while being stirred, followed by warming up for reflux.

Under the reflux, a mixture solution containing 80 parts by mass of styrene, 18 parts by mass of n-butyl acrylate, and 1.8 parts by mass of di-tert-butylperoxide was dropped into the flask over 4 hours. When the mixture solution was dropped for 2 hours, a mixture solution of 2 parts by mass of glycidyl methacrylate and 0.2 part by mass of polymerization initiator 1 was dropped into the flask over 2 hours. After completion of the dropping, the reaction mixture was left standing for 2 hours to complete polymerization and the solvent was then distilled off under reduced pressure, thereby obtaining a glycidyl group-containing vinyl resin (G-1). The physical properties of the resins are shown in Table 1.

As described above, monomers having no carboxyl groups were polymerized in advance and a resin having no acid value was produced, followed by dropping monomers having glycidyl groups to carry out polymerization. Consequently, the resin having glycidyl groups with a certain distance between glycidyl groups can be produced. The use of such a resin allows the production of a vinyl resin unit having a long distance between cross-linking points when reacted with a vinyl resin containing a carboxyl group.

Production Example of Glycidyl Group-Containing Vinyl Resin (G-2)

Like Production Example of the glycidyl group-containing vinyl resin (G-1), 75 parts by mass of styrene, 15 parts by mass of n-butyl acrylate, 10 parts by mass of glycidyl methacrylate, and 3 parts by mass of polymerization initiator 1 were used to obtain a glycidyl group-containing vinyl resin (G-2). The physical properties of the resin are shown in Table 1.

Production Example of Glycidyl Group-Containing Vinyl Resin (G-3)

Like Production Example of the glycidyl group-containing vinyl resin (G-1), 72 parts by mass of styrene, 12 parts by mass of n-butyl acrylate, 16 parts by mass of glycidyl methacrylate, and 2 parts by mass of polymerization initiator 1 were used to obtain a glycidyl group-containing vinyl resin (G-3). The physical properties of the resin are shown in Table 1.

TABLE 1

| Glycidyl group-containing vinyl resin | | | |
|---|---|---|---|
| | G-1 | G-2 | G-3 |
| Number average molecular weight (Mn) | 8000 | 12000 | 3200 |
| Weight average molecular weight (Mw) | 15000 | 20000 | 4000 |

TABLE 1-continued

| Glycidyl group-containing vinyl resin | | | |
|---|---|---|---|
| | G-1 | G-2 | G-3 |
| Glass transition temperature(° C.) | 65.1 | 63.1 | 57.3 |
| Epoxy value(eq/kg) | 0.1 | 1.0 | 6.2 |

Production of Vinyl Resin Unit (V-1)

In a four-necked flask, 200 parts by mass of axylene solution of the low-molecular weight resin component (B-1) (corresponding to 40 parts by mass of a low-molecular weight resin component) was poured and then stirred at increasing temperatures under reflux. Meanwhile, 200 parts by mass of a solution of the high-molecular resin component (A-2) (corresponding to 60 parts by mass of a high-molecular resin component) was poured in another vessel and refluxed.

The solution of the low-molecular weight resin component (B-1) and the solution of the high-molecular weight resin component (A-2) were mixed together under reflux, and an organic solvent was then distilled off. The resulting resin was cooled and solidified, followed by pulverizing. To 100 parts by mass of the resulting pulverized product, a glycidyl group-containing vinyl resin (G-2) was added in an amount of 20 parts by mass (the amount of the epoxy group of the glycidyl group-containing vinyl resin (G-2) corresponds to a 1.0-fold equivalent volume with respect to the carboxyl group of the low-molecular weight resin component and high-molecular weight resin component (B-1) and (A-2)) and then mixed by means of a Henschel mixer (manufactured by Mitsui Mining Co., Ltd.). After that, the mixture was kneaded by means of a twin-screw extruder at 200° C. to proceed a cross-linking reaction, followed by cooling and pulverizing to obtain a vinyl resin unit (V-1). The formulation and physical properties of the resulting vinyl resin unit (V-1) are shown in Table 2.

Production Example of Vinyl Resin Units (V-2) to (V-5)

High-molecular weight resin components (A-1) to (A-3) and low-molecular weight resin components (B-1) to (B-3) were combined as shown in Table 2, respectively. Furthermore, glycidyl-group containing vinyl resins (G-1) to (G-3) were also combined as shown in Table 2, thereby obtaining vinyl resin units (V-2) and (V-3) in a similar manner as that of Production Example of the vinyl resin unit (V-1).

However, the vinyl resin units (V-4) and (V-5) were not subjected to a cross-linking reaction but mixed each other under reflux and then organic solvents were distilled off. The resulting resin was cooled and solidified and then pulverized, thereby obtaining vinyl resin units (V-4) and (V-5), respectively.

TABLE 2

| Vinyl resin unit | | | | | | | | |
|---|---|---|---|---|---|---|---|---|
| | | | | V-1 | V-2 | V-3 | V-4 | V-5 |
| Carboxyl group-containing vinyl resin C | Formulation | High-molecular weight resin component H | Type | A-2 | A-1 | A-1 | A-3 | A-1 |
| | | | Main Peak in molecular weight (MpH) | 210000 | 400000 | 410000 | 830000 | 410000 |

TABLE 2-continued

| | | | Vinyl resin unit | | | | |
|---|---|---|---|---|---|---|---|
| | | | V-1 | V-2 | V-3 | V-4 | V-5 |
| | | Amount of THF-insoluble component (% by mass) | 0 | 0 | 0 | 40.1 | 0 |
| | | Acid value (mgKOH/g) | 21.3 | 18.9 | 18.9 | 19.8 | 18.9 |
| | | Glass transition temperature (° C.) | 61.2 | 59.8 | 59.8 | 60.4 | 59.8 |
| | Low-molecular weight resin component L | Type | B-1 | B-2 | B-1 | B-2 | B-3 |
| | | Main Peak in molecular weight (MpL) | 12700 | 15500 | 12100 | 15100 | 33000 |
| | | Glass transition temperature (° C.) | 60.8 | 59.5 | 60.8 | 59.5 | 62.3 |
| | Mixing ratio L/H (mass ratio) | | 40/60 | 30/70 | 20/80 | 30/70 | 40/60 |
| Physical properties | Acid value (mgKOH/g) | | 10.5 | 9.8 | 11.2 | 9.5 | 21.1 |
| Glycidyl group-containing vinyl resin G | | | G-2 | G-1 | G-3 | — | — |
| | G/C (Mole ratio) *1 | | 1.0 | 0.5 | 5.2 | — | — |
| | G/C (Mass ratio) | | 0.20 | 0.33 | 0.67 | — | — |
| Amount of THF-insoluble component (% by mass) | | | 35.1 | 28.3 | 33.1 | 13.2 | 0.0 |
| Epoxy value (eq/kg) | | | 0.10 | 0.05 | 1.00 | — | — |
| Acid value (mgKOH/g) | | | 9.50 | 8.20 | 10.50 | 9.40 | 20.50 |

*1 The ratio between the mole number of the carboxyl group of the carboxyl group-containing vinyl resin and the mole number of the glycidyl group of the glycidyl group-containing vinyl resin

Production Example of Polyester Unit (P-1)

Among raw materials of 51.5 mol % of sebacic acid, 2.6 mol % of trimellitic anhydride, 39.2 mol % of ethylene glycol, and 6.7 mol % of diethylene glycol, raw materials except for part of the trimellitic anhydride (1.6 mol %) were introduced into autoclave (5 litters) with an esterifying catalyst (dioctyltin oxide) and then a reflux cooling apparatus, a water-separating apparatus, an $N_2$-gas induction tube, a thermometer, and a stirrer were attached to the autoclave. A polymerization condensation reaction was carried out at 230° C., while introducing $N_2$ gas into the autoclave. The percentage of completion of the reaction was monitored with respect to viscosity, and, when the reaction almost reached its last stage, the remaining trimellitic anhydride (1.6 mol %) was added to initiate a further reaction. The physical properties of the resulting polyester unit (P-1) are shown in Table 3.

Furthermore, the timing of the addition of trimellitic anhydride was judged as follows.

The viscosity of the polyester unit having a molecular weight corresponding to almost 90% of the previously determined desired molecular weight was determined in advance. When the viscosity of a sample taken from a reaction system had reached the desired viscosity, the trimellitic anhydride was added.

Production Examples of Polyester Units (P-2) to (P-4)

In a manner similar to Production Method of the polyester unit (P-1), polyester units (P-2) to (P-4) were obtained using raw material monomers shown in Table 3, respectively. However, for the polyester units (P-3) and (P-4), the whole amount of trimellitic anhydride was added at the start of the reaction. The physical properties of the resulting polyester units are shown in table 3, respectively.

TABLE 3

| | Polyester unit | | | |
|---|---|---|---|---|
| | P-1 | P-2 | P-3 | P-4 |
| Monomer component | SA 51.5 mol % TMA 2.6 mol % EG 39.2 mol % DEG 6.7 mol % | AA 50.1 mol % TMA 6.8 mol % EG 43.1 mol % — | SA 32.1 mol % TPA 25.4 mol % TMA 3.1 mol % EG 39.4 mol % | TPA 40.1 mol % TMA 18.9 mol % BPA-PO 30.5 mol % EG 10.5 mol % |
| Main Peak in molecular weight Mp | 5000 | 10000 | 7000 | 12000 |
| Weight average molecular weight (Mw) | 5200 | 12000 | 8500 | 120000 |
| Acid value (mgKOH/g) | 8.3 | 9.6 | 12.3 | 15.1 |
| Maximum endothermic peak temperature (° C.) | 70 | 75 | none | none |

In Table 3, "SA" represents sebacic acid, "EG" represents ethylene glycol, "AA" represents adipic acid, "DEG" represents diethylene glycol, "TPA" represents terephthalic acid, "BPA-PO" represents a propylene oxide adduct of bisphenol A, and "TMA" represents trimellitic anhydride, respectively.

Example 1

Vinyl resin unit (V-1) 80 parts by mass

Polyester unit (P-1) 12 parts by mass (the amount that the number of the carboxyl groups of the polyester unit (P-1) was 5-mol times as high as the number of carboxyl group of the vinyl resin unit (V-1))

Styrene-butadiene copolymer 20 parts by mass (styrene:butadiene=80:20 (mass ratio), main-peak in molecular weight: 22,000, Mw (weight average molecular weight): 240,000, Mn (number average molecular weight): 18,000)

Magnetic iron oxide particle (octahedron, number average primary particle size 0.2 μm) 90 parts by mass Wax (Fischer-Tropsch wax having a temperature at which the maximum endothermic peak of DSC can be obtained of 105° C., Mw (weight average molecular weight) 2500, Mn (number average molecular weight) 1500) 4 parts by mass Charge-controlling agent 1 (triphenyl methane lake pigment: represented by the following formula (2)) 2 part by mass (2)

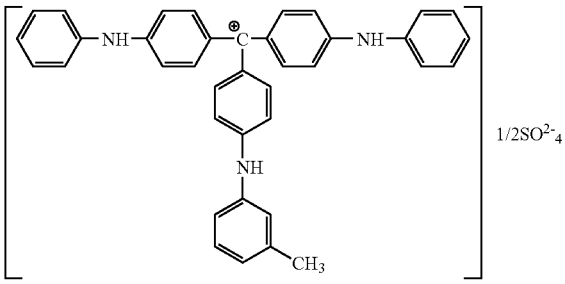

The above materials were pre-mixed by means of a Henschel mixer and then melt-kneaded by means of a twin-screw extruder.

The resulting kneaded product was cooled and roughly pulverized with a hammer mill. The resulting crude pulverized product was further pulverized with a fine pulverizer using a jet stream. The resulting fine particles were subjected to a multi-division classifier using a Coanda effect to fractionate the particles, thereby obtaining toner particles having a weight average particle size (D4) of 7.5 μm. Furthermore, the weight average particle size of toner particles can also be measured using a particle-size measuring apparatus using an electrolyte. The particle-size measuring apparatus may be a Coulter Counter Model TA-II or Coulter Multisizer (manufactured by Coulter Electronics, Inc.). In this case, the electrolyte may be, for example, an aqueous solution of about 1% NaCl. In addition, the above measuring apparatus may have an aperture of 100 μm.

To 100 parts by mass of toner particles, 0.8 part by mass of hydrophobic silica fine particles, which were treated with 17 parts by mass of amino-modified silicone oil (amino equivalent: 830, viscosity at 25° C.: 70 $mm^2/S$), and 3.0 parts by mass of strontium titanate were externally mixed, and the whole was filtrated out through a 150-μm mesh filter, thereby obtaining toner 1. The formulation for internal addition and physical property values of the toner 1 are listed in Table 4.

200,000 prints (double-faced printing, actual number of printed sheets was 100,000) were subjected to a continuous printing test using a commercially available copying machine (IR-105, manufactured by Canon Inc.) in which a printing speed was modified to 1.5 times as high as the normal, using the toner 1 in environments (23° C., 5% RH; 23° C., 60% RH; 32° C., 80% RH) withatest chart (printing ratio: 4%). The results are shown in Tables 6 to 8.

Furthermore, the heated-roll fuser of the copying machine was taken out. The fuser was modified such that the fuser was able to actuate even in the outside of the copying machine and the fixing roller temperature, processing speed, and applied pressure were able to be controlled according to need to provide an external fuser. Thus, the toner was evaluated for fixing ability and offset resistance using such a modified fuser. The results of the evaluation are shown in Table 5.

The evaluation for fixing ability was carried out under the conditions including the process speed set at 650 mm/sec and the applied pressure set at 40 $kgf/cm^2$ (3.9 mPa), while the temperature of the fuser used was set at 140° C. Then, two types of unfixed images (solid black and half tone) were formed on paper (90 $g/m^2$) and then the paper was passed through the fuser to fix, thereby obtaining a fixed image. The resulting fixed image was loaded with a load of 50 $g/cm^2$ and then rubbed with lens-cleaning paper. The percentages (%) of lowering the image density before and after rubbing with the lens-cleaning paper were obtained and evaluated on the basis of the following criteria.

A: Less than 10%

B: 10% or more but less than 20%

C: 20% or more

The evaluation for offset resistance was carried out under the conditions of 40 mm/sec in process speed and 50 $kgf/cm^2$ in applied pressure and using the heated fuser and adjusted at 240° C. Subsequently, an unfixed image having an image area ratio of about 5% was formed on paper (50 $g/m^2$) and then the paper was passed through the fuser to fix, thereby obtaining a fixed image. The image was evaluated on the basis of the degree of dirt visually observed.

A: Good

B: Negligibly small dirt

C: Generation of dirt influencing the image quality

The continuous printing test was performed. The image density was determined by means of reflection density measurement using a Macbeth densitometer (manufactured by Macbeth Co., Ltd.) with an SPI filter. The measurement of image density was carried out on an image (5 mm×5 mm).

The evaluation for fogging caused in the continuous printing test was performed using a reflection densitometer (Reflectometer Model TC-6DS, manufactured by Tokyo Denshoku K.K.). The worst value of reflection density of the white area after forming a solid white image was determined as Ds and the average reflection density of a transfer material before the image formation was determined as Dr. Then Ds-Dr was determined as the amount of fogging to perform evaluation for fogging. As the fogging value is lower, the inhibition of the fogging is more excellent. The worst value of the reflection density of the white area after the image formation was the maximum measurement value when the whole white area was measured using the reflection densitometer.

The evaluation for the dot reproducibility in the continuous printing test was carried out as described below. 100 images of independent dots (each 50 μm in diameter) were formed on the sheets at the time of initial print and 200,000th print, respectively. And then, the dot reproducibility was evaluated in a manner how many dots were represented out of 100 dots. In addition, the performance stability with respect to an image quality was also evaluated as follows.

A: 2 dots or less of (initial number of dots)−(number of dots after 200,000 continual printing, printed only one side) (and also the initial dot reproducibility is 95 to 100).

B: 3 to 7 dots of (initial number of dots)−(number of dots after 200,000 continual printing, printed only one side) (and also the initial dot reproducibility is 93 or more).

C: 8 dots or more of (initial number of dots)−(number of dots after 200,000 continual printing, printed only one side).

Furthermore, the consumption of toner in the continuous printing test was evaluated. Under 23° C. and 60% RH environment, after the continuous printing test for 200,000 prints had been carried out, a toner container filled with 1.6 kg of toner was used and the number of sheets of printed paper was then counted, followed by evaluating the count as follows.

A: Capable of printing 35,000 or more prints.

B: Capable of printing 30,000 or more but less than 35,000 prints.

C: Impossible to print 30,000 prints.

Examples 2 to 5

In a manner similar to Example 1, toners 2 to 5 were prepared using the formulations described in Table 4. The physical properties of the obtained toners are shown in Table 4, respectively. The results of the tests similar to those described above are shown in Tables 5 to 8, respectively.

Comparative Examples 1 to 3

In a manner similar to Example 1, toners 9 to 11 were prepared using the formulations described in Table 4. The physical properties of the toners thus obtained are shown in Table 4, respectively. The results of the tests similar to those described above are shown in Tables 5 to 8, respectively.

Example 6

Vinyl resin unit (V-2) 80 parts by mass

Polyester unit (P-3) 7 parts by mass (the amount added in which the number of the carboxyl groups of the polyester unit (P-3) was 7-mol times as high as the number of carboxyl group of the vinyl resin unit (V-2))

Magnetic iron oxide particle (multinuclear form, number average primary particle size 0.19 μm) 95 parts by mass Wax (Fischer-Tropsch wax having a temperature at which the maximum endothermic peak of DSC can be obtained of 105° C., Mw (weight average molecular weight) 2500, Mn (number average molecular weight) 1500) 4 parts by mass Charge-controlling agent 2 (azo-based iron complex: represented by the following formula (3)) 2 part by mass

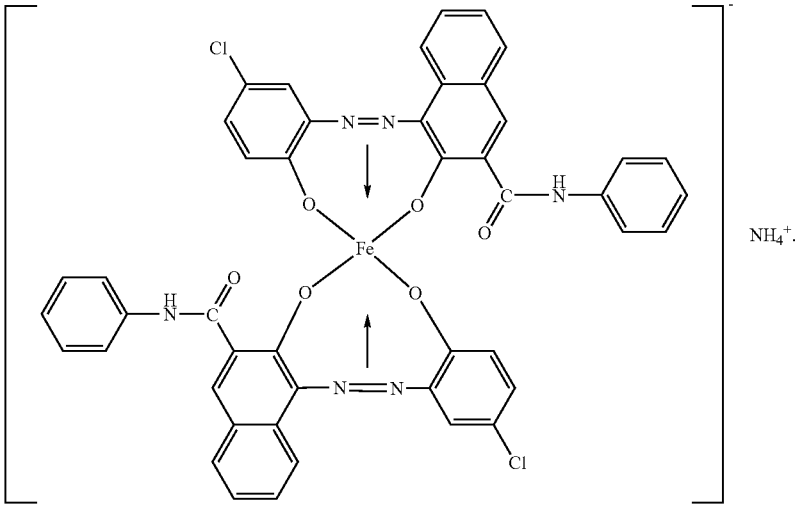

(3)

The materials were pre-mixed by means of a Henschel mixer and then melt-kneaded by means of a twin-screw extruder. At this time, retention time was controlled in such a manner that the kneaded resin would have a temperature of 150° C.

The resulting kneaded product was cooled and roughly pulverized with a hammer mill and then the resultant hammered product was finely pulverized with a jet-stream pulverizing mill. The resulting pulverized powder was classified using a fractionating classifier based on Coanda effect to obtain toner particles with a weight average particle size of 6.5 μm. Subsequently, 1.2 parts by mass of hydrophobic silica fine powder (prepared using hydrophobic treatment of 15 mass % hexamethyldisilane and 15 mass % dimethylsilicone oil, with 80% methanol wettability, and a BET specific surface area of 120 $m^2/g$) and 1.0 parts by mass of strontium titanate were externally added to 100 parts by mass of the toner particles, and then the whole was filtrated through a 150-μm pore size mesh filter, thereby obtaining Toner No. 6. Formulations for internal addition, and physical property values of the toners are shown in Tables 4.

10,000 sheets were subjected to a continuous printing test using a commercially available laser beam printer (Laser Jet 4300, manufactured by Hewlett-Packard Development Company (HP)) in which a printing speed was modified to 1.5 times as high as the normal using the toner 6 as a toner in environments (15° C., 10% RH; 23° C., 60% RH; 32° C., 80% RH) with a test chart (printing ratio: 4%). The results are shown in Tables 9 to 11.

Furthermore, the test for fixing ability was carried out in a manner similar to Example 1. The image density was measured by the same way as that of Example 1 by means of reflection density measurement using a Macbeth densitometer (manufactured by Macbeth Co., Ltd.) with an SPI filter. The measurement of reflection density was carried out on an image (5 mm×5 mm).

In a manner similar to Example 1, the evaluation for fogging was performed using a reflection densitometer (Reflectometer Model TC-6DS, manufactured by Tokyo Denshoku K.K.). The worst value of reflection density of a white area after forming a solid white image was determined as Ds and the average reflection density of a transfer material before the image formation was determined as Dr. Then Ds-Dr was determined as the amount of fogging, thereby carrying out the evaluation for fogging.

The evaluation for the dot reproducibility was carried out in a manner similar to Example 1. 100 images of independent dots (each 50 μm in diameter) were formed on the sheets at the time of initial print and 10,000th print, respectively. And then, the dot reproducibility was evaluated in a manner how many dots were represented out of 100 dots. In addition, the performance stability with respect to an image quality was also evaluated as follows.

A: 2 dots or less of (initial number of dots)−(number of dots after 10,000 enduring printing).

B: 3 to 7 dots of (initial number of dots)−(number of dots after 10,000 enduring printing).

C: 8 dots or more of (initial number of dots)−(number of dots after 10,000 enduring printing).

Examples 7 and 8

In a manner similar to Example 6, toners 7 and 8 were prepared using the formulations described in Table 4. The physical properties of the obtained toners are shown in Table 4, respectively. The results of the tests similar to those described above are shown in Tables 5 and 9 to 11, respectively.

Comparative Example 4

In a manner similar to Example 6, a toner 12 was prepared using the formulations described in Table 4. The physical properties of the obtained toner are shown in Table 4. The results of the tests similar to those described above are shown in Tables 5 and 9 to 11, respectively.

This application claims priority from Japanese Patent Application No. 2004-352911 filed Dec. 6, 2004, which is hereby incorporated by reference herein.

TABLE 4

Physical properties of toner

| | Example 1 | Example 2 | Example 3 | Example 4 | Example 5 | Example 6 | Example 7 |
|---|---|---|---|---|---|---|---|
| Toner No. | 1 | 2 | 3 | 4 | 5 | 6 | 7 |
| Vinyl resin unit (I) | V-1 | V-1 | V-1 | V-2 | V-3 | V-2 | V-2 |
| Polyester unit (II) | P-1 | P-1 | P-3 | P-2 | P-1 | P-3 | P-2 |
| Resin-mixing ratio *1 (II)/(I)mole ratio | 5 | 20 | 10 | 0.1 | 1 | 7 | 10 |
| Resin-mixing ratio (II)/(I)mass ratio | 0.15 | 0.61 | 0.43 | 0.01 | 0.54 | 0.09 | 0.2 |
| Charge-controlling agent | 1 | 1 | 1 | 1 | 1 | 2 | 2 |
| Magnetic iron oxide | Octahedron | Octahedron | Octahedron | Octahedron | Multinuclear form | Multinuclear form | Spherical form |
| Aliphatic diene compound | Presence | Presence | Presence | absence | Presence | absence | absence |
| THF-insoluble fraction (mass %) | 42 | 40 | 44 | 28 | 33 | 26 | 25 |
| Acid value (mgKOH/g) | 8.9 | 9.2 | 10.5 | 9.5 | 9.3 | 11.5 | 8.5 |
| Epoxy value (eq/kg) | 0.090 | 0.060 | 0.070 | 0.050 | 0.070 | 0.045 | 0.042 |
| Main-Peak molecular weight of THF-soluble fraction | 13000 | 12700 | 13100 | 15200 | 12100 | 16000 | 15500 |
| Area percentage (%) of region of a molecular weight of 100,000 or less in chromatogram | 82 | 80 | 84 | 75 | 89 | 76 | 74 |

| | Example 8 | Comparative Example 1 | Comparative Example 2 | Comparative Example 3 | Comparative Example 4 |
|---|---|---|---|---|---|
| Toner No. | 8 | 9 | 10 | 11 | 12 |
| Vinyl resin unit (I) | V-3 | V-5 | V-3 | V-4 | V-1 |
| Polyester unit (II) | P-3 | P-4 | — | P-1 | — |
| Resin-mixing ratio *1 (II)/(I)mole ratio | 8 | 5 | — | 5 | — |
| Resin-mixing ratio (II)/(I)mass ratio | 0.12 | 0.2 | 0 | 0.04 | 0 |
| Charge-controlling agent | 2 | 1 | 1 | 1 | 2 |
| Magnetic iron oxide | Multinuclear form | Multinuclear form | Multinuclear form | Multinuclear form | Spherical form |
| Aliphatic diene compound | Presence | Presence | Presence | absence | Presence |
| THF-insoluble fraction (mass %) | 35 | 40 | 37 | 8 | 37 |
| Acid value (mgKOH/g) | 12.1 | 19.1 | 11.1 | 8.7 | 8.8 |
| Epoxy value (eq/kg) | 0.900 | — | 1.000 | — | 0.100 |
| Main-Peak molecular weight of THF-soluble fraction | 12500 | 32200 | 12700 | 15800 | 13100 |
| Area percentage (%) of region of a molecular weight of 100,000 or less in chromatogram | 91 | 58 | 92 | 54 | 83 |

*1 mole ratio between carboxyl group of vinyl resin unit (I) and carboxyl group of polyester unit (II)

TABLE 5

| Results of evaluation for fixing ability | Solid black fixing ability | Halftone fixing ability | Offset resistance |
|---|---|---|---|
| Example 1 | A | A | A |
| Example 2 | A | A | B |
| Example 3 | B | A | A |
| Example 4 | A | A | A |
| Example 5 | A | A | A |
| Example 6 | B | A | A |
| Example 7 | A | A | A |

TABLE 5-continued

| Results of evaluation for fixing ability | Solid black fixing ability | Halftone fixing ability | Offset resistance |
|---|---|---|---|
| Example 8 | B | B | A |
| Comparative Example 1 | B | C | B |
| Comparative Example 2 | B | C | C |
| Comparative Example 3 | C | C | B |
| Comparative Example 4 | B | C | A |

TABLE 6

Evaluation results of each toner under high temperature and high humidity (32° C., 80% RH)

| | Initial | | | After continuous printing of 200,000 prints (double-faced printing, actual number of printed sheets was 100,000) | | | Performance |
|---|---|---|---|---|---|---|---|
| | Image density | Fogging | Dot reproducibility | Image density | Fogging | Dot reproducibility | stability of image quality |
| Example 1 | 1.41 | 0.7 | 98 | 1.40 | 0.7 | 97 | A |
| Example 2 | 1.42 | 0.8 | 100 | 1.40 | 1.1 | 96 | B |
| Example 3 | 1.39 | 1.2 | 95 | 1.37 | 1.8 | 88 | B |
| Example 4 | 1.40 | 1.0 | 96 | 1.39 | 1.1 | 94 | A |
| Example 5 | 1.42 | 1.0 | 95 | 1.35 | 1.3 | 91 | B |
| Comparative Example 1 | 1.40 | 1.0 | 93 | 1.30 | 2.1 | 80 | C |
| Comparative Example 2 | 1.35 | 2.0 | 88 | 1.28 | 2.4 | 78 | C |
| Comparative Example 3 | 1.40 | 1.2 | 90 | 1.21 | 3.8 | 75 | C |

TABLE 7

Evaluation results of each toner under normal temperature and normal humidity (23° C., 60% RH)

| | Initial | | | After continuous printing of 200,000 prints (double-faced printing, actual number of printed sheets was 100,000) | | | Performance | |
|---|---|---|---|---|---|---|---|---|
| | Image density | Fogging | Dot reproducibility | Image density | Fogging | Dot reproducibility | stability of image quality | Toner consumption |
| Example 1 | 1.40 | 1.0 | 100 | 1.39 | 1.2 | 99 | A | A |
| Example 2 | 1.41 | 1.2 | 98 | 1.39 | 1.5 | 96 | B | B |
| Example 3 | 1.37 | 1.5 | 96 | 1.37 | 1.5 | 92 | B | B |
| Example 4 | 1.39 | 1.2 | 99 | 1.39 | 1.3 | 98 | A | A |
| Example 5 | 1.42 | 1.3 | 97 | 1.41 | 1.5 | 93 | B | B |
| Comparative Example 1 | 1.41 | 1.2 | 97 | 1.39 | 1.7 | 89 | C | C |
| Comparative Example 2 | 1.36 | 1.9 | 90 | 1.31 | 2.5 | 80 | C | C |
| Comparative Example 3 | 1.39 | 1.3 | 95 | 1.27 | 2.4 | 85 | C | C |

TABLE 8

Evaluation results of each toner under normal temperature and low humidity (23° C., 5% RH)

| | Initial | | | After continuous printing of 200,000 prints (double-faced printing, actual number of printed sheets was 100,000) | | | Performance |
|---|---|---|---|---|---|---|---|
| | Image density | Fogging | Dot reproducibility | Image density | Fogging | Dot reproducibility | stability of image quality |
| Example 1 | 1.41 | 1.1 | 99 | 1.41 | 1.3 | 99 | A |
| Example 2 | 1.42 | 1.3 | 99 | 1.40 | 1.5 | 96 | B |

TABLE 8-continued

| Evaluation results of each toner under normal temperature and low humidity (23° C., 5% RH) | | | | | | | |
|---|---|---|---|---|---|---|---|
| | Initial | | | After continuous printing of 200,000 prints (double-faced printing, actual number of printed sheets was 100,000) | | | Performance |
| | Image density | Fogging | Dot reproducibility | Image density | Fogging | Dot reproducibility | stability of image quality |
| Example 3 | 1.36 | 2.0 | 95 | 1.33 | 2.1 | 88 | B |
| Example 4 | 1.43 | 1.4 | 100 | 1.43 | 1.6 | 99 | A |
| Example 5 | 1.40 | 1.7 | 97 | 1.36 | 2.6 | 90 | B |
| Comparative Example 1 | 1.43 | 2.6 | 93 | 1.42 | 2.8 | 82 | C |
| Comparative Example 2 | 1.33 | 3.2 | 90 | 1.33 | 3.1 | 82 | C |
| Comparative Example 3 | 1.34 | 3.1 | 85 | 1.22 | 4.5 | 74 | C |

TABLE 9

| Evaluation results of each toner under high temperature and high humidity (32° C., 80% RH) | | | | | | | |
|---|---|---|---|---|---|---|---|
| | Initial | | | After continuous printing of 10,000 sheets | | | Performance |
| | Image density | Fogging | Dot reproducibility | Image density | Fogging | Dot reproducibility | stability of image quality |
| Example 6 | 1.41 | 1.3 | 95 | 1.37 | 1.5 | 88 | B |
| Example 7 | 1.40 | 0.9 | 100 | 1.40 | 1.0 | 99 | A |
| Example 8 | 1.40 | 1.2 | 93 | 1.35 | 1.7 | 87 | B |
| Comparative Example 4 | 1.37 | 1.5 | 93 | 1.31 | 2.2 | 81 | C |

TABLE 10

| Evaluation results of each toner under normal temperature and normal humidity (23° C., 60% RH) | | | | | | | |
|---|---|---|---|---|---|---|---|
| | Initial | | | After continuous printing of 10,000 sheets | | | Performance |
| | Image density | Fogging | Dot reproducibility | Image density | Fogging | Dot reproducibility | stability of image quality |
| Example 6 | 1.40 | 1.4 | 97 | 1.39 | 1.6 | 94 | B |
| Example 7 | 1.41 | 1.1 | 100 | 1.41 | 1.2 | 99 | A |
| Example 8 | 1.42 | 1.3 | 96 | 1.40 | 1.5 | 92 | B |
| Comparative Example 4 | 1.40 | 1.5 | 95 | 1.37 | 1.7 | 88 | B |

TABLE 11

| Evaluation results of each toner under low temperature and low humidity (15° C., 10% RH) | | | | | | | |
|---|---|---|---|---|---|---|---|
| | Initial | | | After continuous printing of 10,000 sheets | | | Performance |
| | Image density | Fogging | Dot reproducibility | Image density | Fogging | Dot reproducibility | stability of image quality |
| Example 6 | 1.41 | 1.5 | 93 | 1.40 | 2.1 | 86 | B |
| Example 7 | 1.41 | 1.2 | 100 | 1.40 | 1.5 | 100 | A |
| Example 8 | 1.40 | 1.6 | 94 | 1.37 | 2.3 | 89 | B |
| Comparative Example 4 | 1.40 | 2.5 | 90 | 1.33 | 3.1 | 80 | C |

What is claimed is:

1. A toner comprising:

a binder resin and a colorant;

wherein said toner contains a THF-soluble component to be dissolved in tetrahydrofuran (THF) and wherein a binder resin component contained in the THF-soluble component contains:

a vinyl resin unit (I) formed by reacting carboxyl group(s) of a carboxyl group-containing vinyl resin and epoxy group(s) of an epoxy group-containing vinyl resin and having an epoxy value of 0.001 to 1.000 eq/kg, and a polyester unit (II) formed by condensation polymerization of monomers each containing fatty acid having 4 to 12 carbon atoms, aromatic tricarboxylic acid, and ethylene glycol, wherein the polyester unit (II) has a maximum endothermic peak in a DSC (differential scanning calorimeter) curve in a region ranging from the temperature of 50 to 100° C. on measurement of thermal properties by means of a differential scanning calorimeter;

said toner having a main peak in a molecular weight region ranging from 3,000 to 30,000 on measurement of a molecular weight distribution of the THF-soluble component by gel permeation chromatography (GPC)

wherein the binder resin contains the vinyl resin unit (I) and the polyester unit (II) such that 0.01 to 10.00 moles of the carboxyl group in the polyester unit (II) is contained with respect to 1.00 mole of the carboxyl group in the vinyl resin unit (I).

2. A toner according to claim 1, wherein an area of a molecular weight of 100,000 or less in a chromatogram for the molecular weight distribution of the THF-soluble component accounts for 70 to 100% of the whole area.

3. A toner according to claim 1, comprising 10 to 50% by mass of a THF-insoluble component at 16-hour extraction with THF with respect to the total amount of a resin component in the toner.

4. A toner according to claim 1, wherein the carboxyl group-containing vinyl resin has at least one peak in a molecular weight region ranging from 4,000 to 30,000 and at least one peak in a molecular weight region ranging from 100,000 to 400,000 on the measurement by gel permeation chromatography (GPC).

5. A toner according to claim 1, wherein the epoxy group-containing vinyl resin has a weight average molecular weight of 3,000 to 40,000 on the measurement by gel permeation chromatography (GPC) and the epoxy group-containing vinyl resin has an epoxy value of 0.01 to 5.00 eq/kg.

6. A toner according to claim 1, wherein the vinyl resin unit (I) is formed by a carboxyl group-containing vinyl resin and an epoxy group-containing vinyl resin having 0.05 to 5.00 moles of an epoxy group per mole of a carboxyl group in the carboxyl group-containing vinyl resin.

7. A toner according to claim 1, wherein the polyester unit (II) has at least one peak in a molecular weight region ranging from 3,000 to 10,000 and a weight average molecular weight (Mw) of 3,000 to 15,000 on the measurement by gel permeation chromatography (GPC).

8. A toner according to claim 1, wherein the colorant is magnetic iron oxide.

9. A toner according to claim 8, wherein the magnetic iron oxide comprises at least one of a magnetic iron oxide particle having an octahedral form and a magnetic iron oxide fine particle having a multinuclear form.

10. A toner according to claim 8, wherein a content of the magnetic iron oxide is 20 to 200 parts by mass with respect to 100 parts by mass of the binder resin.

11. A toner according to claim 4, wherein the epoxy group-containing vinyl resin has a weight average molecular weight of 3,000 to 40,000 on the measurement by gel permeation chromatography (GPC) and the epoxy group-containing vinyl resin has an epoxy value of 0.01 to 5.00 eq/kg.

12. A toner according to claim 11, wherein the vinyl resin unit (I) is formed by a carboxyl group-containing vinyl resin and an epoxy group-containing vinyl resin having 0.05 to 5.00 moles of an epoxy group per mole of a carboxyl group in the carboxyl group-containing vinyl resin.

13. A toner according to claim 12, wherein the polyester unit (II) has at least one peak in a molecular weight region ranging from 3,000 to 10,000 and a weight average molecular weight (Mw) of 3,000 to 15,000 on the measurement by gel permeation chromatography (GPC).

* * * * *